US012433410B2

(12) United States Patent
Brandtner et al.

(10) Patent No.: US 12,433,410 B2
(45) Date of Patent: Oct. 7, 2025

(54) UPHOLSTERED RECLINER INCLUDING MOLDED FURNITURE COMPONENTS

(71) Applicant: Ashley Furniture Industries, LLC, Arcadia, WI (US)

(72) Inventors: Timothy A. Brandtner, Ettrick, WI (US); Nicholas J. Robinson, Ettrick, WI (US); Philip Bramlett, Ripley, MS (US)

(73) Assignee: Ashley Furniture Industries, LLC, Arcadia, WI (US)

( * ) Notice: Subject to any disclaimer, the term of this patent is extended or adjusted under 35 U.S.C. 154(b) by 104 days.

(21) Appl. No.: 18/193,325

(22) Filed: Mar. 30, 2023

(65) Prior Publication Data

US 2023/0232987 A1 Jul. 27, 2023

Related U.S. Application Data

(63) Continuation-in-part of application No. 17/481,151, filed on Sep. 21, 2021, now Pat. No. 11,696,644, (Continued)

(51) Int. Cl.
*A47C 4/02* (2006.01)
*A47C 1/02* (2006.01)
(Continued)

(52) U.S. Cl.
CPC ..... *A47C 7/185* (2013.01); *A47C 1/02* (2013.01); *A47C 5/12* (2013.01); *A47C 7/54* (2013.01); *A47C 17/02* (2013.01)

(58) Field of Classification Search
CPC .. A47C 1/02; A47C 4/028; A47C 5/12; A47C 17/16; A47C 17/02
(Continued)

(56) References Cited

U.S. PATENT DOCUMENTS 1,716,176 A * 6/1929 Vitez-Keresztfalvy ..... A47C 31/04 5/191
1,772,979 A * 8/1930 Bell ..... A47C 17/16 297/452.59
(Continued)

FOREIGN PATENT DOCUMENTS

CN 201019326 Y 2/2008
CN 201290461 Y 8/2009
(Continued)

OTHER PUBLICATIONS

Admitted prior art dated at least as early as Jul. 20, 2018, 3 pages.
(Continued)

*Primary Examiner* — Rodney B White
(74) *Attorney, Agent, or Firm* — Christensen, Fonder, Dardi & Herbert PLLC; Douglas J. Christensen; Andrew H. Auderieth

(57) ABSTRACT

An upholstered recliner, a frame including a pair blow molded hollow arm rest forms. Further components may be blow molded such as a back rest. The arm rest forms and backrest forms may be reinforced with metal plates and assembled into a recliner. The backrest form may have legs with kd brackets secured thereto by clamping onto the portions of the legs of the backrest forms. The connections to the backrest form and arm rest forms providing a geometrically rigid and robust frame that is weighs less, is quicker to assemble, and is more robust that conventional wood frame recliners.

20 Claims, 20 Drawing Sheets

Related U.S. Application Data which is a continuation-in-part of application No. PCT/US2021/022645, filed on Mar. 16, 2021, and a continuation-in-part of application No. 16/525,539, filed on Jul. 29, 2019, now Pat. No. 11,122,907.

(60) Provisional application No. 63/482,991, filed on Feb. 2, 2023, provisional application No. 63/325,337, filed on Mar. 30, 2022, provisional application No. 63/039,445, filed on Jun. 15, 2020, provisional application No. 62/990,287, filed on Mar. 16, 2020, provisional application No. 62/711,168, filed on Jul. 27, 2018.

(51) Int. Cl.
*A47C 5/12* (2006.01)
*A47C 7/18* (2006.01)
*A47C 7/54* (2006.01)
*A47C 17/02* (2006.01)

(58) Field of Classification Search
USPC ..... 297/440.1–440.23
See application file for complete search history.

(56) References Cited

U.S. PATENT DOCUMENTS 2,829,707 A * 4/1958 Liebson ..... A47C 4/028 297/411.42
2,838,100 A * 6/1958 Follows ..... A47C 5/125 29/91.1
3,030,146 A * 4/1962 Faxon ..... A47C 4/028 297/440.1
3,036,864 A * 5/1962 Arai ..... A47C 4/02 297/440.16
3,104,913 A * 9/1963 Faulkner ..... A47C 4/028 297/440.1
3,115,093 A * 12/1963 Andrus ..... B41F 15/36 101/127.1
3,183,036 A * 5/1965 Hill ..... A47C 4/028 297/440.22
3,333,841 A * 8/1967 Damiano ..... A47C 23/26 297/452.56
3,375,861 A * 4/1968 Marlow ..... A47C 31/04 297/DIG. 2
3,414,912 A * 12/1968 Dusey, Sr. ..... A47C 17/86 5/52
3,423,772 A * 1/1969 Mainguy ..... A47B 85/00 5/2.1
3,467,433 A * 9/1969 Lindekrantz ..... A47C 4/021 297/451.3
3,497,883 A * 3/1970 Arnold ..... A47C 7/32 297/452.52
3,498,598 A * 3/1970 Rathbun ..... B60N 2/7058 123/198 R
D217,910 S * 6/1970 Harman ..... D6/717
3,528,096 A * 9/1970 Moberg ..... A47C 13/00 297/118
3,642,323 A * 2/1972 Taylor ..... A47C 5/125 297/452.17
3,658,382 A * 4/1972 Anderson ..... F16B 12/00 403/219
3,669,495 A * 6/1972 Von Rudgisch ..... A47C 4/02 297/DIG. 2
3,690,723 A * 9/1972 McClain ..... A47C 1/0345 297/271.4
3,700,282 A * 10/1972 Rowland ..... A47C 7/20 297/228.1
3,722,954 A * 3/1973 Rey ..... A47C 31/02 297/452.59
3,874,727 A * 4/1975 Mehnert ..... A47C 3/12 297/320
3,877,087 A * 4/1975 Harty ..... A47C 17/134 5/36
3,887,234 A * 6/1975 Curtis ..... A47C 5/12 D6/705
4,067,073 A * 1/1978 Komarov ..... A47C 17/132 297/440.1
4,074,919 A * 2/1978 Watts ..... A47C 4/028 297/440.1
4,077,517 A * 3/1978 Hilemn ..... A47C 4/02 297/440.1
D250,502 S * 12/1978 Trimble ..... D6/716
4,165,902 A * 8/1979 Ehrlich ..... A47C 4/02 297/440.11
4,285,080 A * 8/1981 Kitchen ..... A47C 23/20 5/186.1
4,285,544 A * 8/1981 Zapf ..... A47C 17/045 297/DIG. 2
4,523,787 A * 6/1985 Robinson ..... A47C 4/02 297/440.22
4,588,227 A * 5/1986 Austin ..... A47C 5/10 403/255
4,601,516 A * 7/1986 Klein ..... A47C 4/02 297/440.11
4,632,459 A * 12/1986 Herschlag ..... A47C 4/028 297/42
4,768,833 A * 9/1988 Virtue ..... A47C 5/12 297/DIG. 2
4,775,187 A * 10/1988 Herr ..... A47C 5/12 297/DIG. 2
4,828,324 A * 5/1989 Putnam ..... F16B 9/058 403/189
4,848,839 A * 7/1989 Galardo ..... A47C 4/02 5/12.2
5,000,512 A * 3/1991 Laird ..... A47C 4/028 297/440.22
5,080,438 A * 1/1992 Moyer ..... A47C 4/028 297/440.23
5,265,939 A * 11/1993 Self ..... A47C 13/005 297/440.13
5,411,316 A * 5/1995 Lovegrove ..... A47C 7/44 297/DIG. 2
5,423,596 A * 6/1995 Laughlin ..... A47C 13/005 297/440.1
5,447,005 A * 9/1995 Giannuzzi ..... F16B 13/122 411/29
5,575,533 A * 11/1996 Glance ..... B29C 49/04 297/452.2
5,582,460 A * 12/1996 Schultz ..... A47C 7/402 297/DIG. 2
5,601,340 A * 2/1997 Stout ..... A47C 4/02 297/440.16
5,678,897 A * 10/1997 Prestia ..... A47C 4/028 297/440.15
5,727,849 A * 3/1998 Nelson ..... A47C 13/005 297/440.16
5,738,414 A * 4/1998 Wieland ..... A47C 4/02 297/440.1
5,755,489 A * 5/1998 Rossman ..... A47C 4/02 297/440.16
5,775,778 A * 7/1998 Riley ..... A47C 7/425 297/226
5,795,028 A * 8/1998 Dussia, Jr. ..... A47C 13/005 297/344.21
5,890,767 A * 4/1999 Chang ..... A47C 7/546 297/440.22
D425,338 S * 5/2000 Schlichter ..... D6/717
6,109,687 A * 8/2000 Nye ..... A47C 11/00 297/159.1
6,241,312 B1 * 6/2001 Watts ..... A47C 11/00 297/125
6,241,317 B1 * 6/2001 Wu ..... A47C 4/02 297/440.1
6,367,874 B2 * 4/2002 Casini ..... A47D 9/053 297/130
6,367,880 B1 * 4/2002 Niederman ..... A47C 4/02 297/440.16

(56) References Cited

U.S. PATENT DOCUMENTS 6,474,738 B1 * 11/2002 Ratza ..... B60N 2/7094 297/337
6,679,558 B2 * 1/2004 Adams ..... A47C 5/12 297/DIG. 2
6,702,391 B1 * 3/2004 Stipek ..... A47C 5/12 297/451.12
6,796,614 B1 * 9/2004 Paul ..... A47C 7/42 297/118
6,827,407 B2 * 12/2004 Niederman ..... A47C 4/02 297/440.14
D501,340 S * 2/2005 Grossman ..... D6/717
6,854,806 B2 * 2/2005 Huse ..... A47C 5/12 297/DIG. 2
6,942,298 B2 * 9/2005 Harrison ..... A47C 17/04 297/440.1
7,070,243 B1 * 7/2006 Frank ..... A47C 5/12 297/452.14
7,134,728 B1 * 11/2006 Buhrman ..... A47C 5/12 297/440.14
7,252,339 B2 * 8/2007 Owens ..... A47C 7/42 297/440.16
7,300,111 B2 * 11/2007 Huang ..... A47C 4/02 297/440.16
7,434,304 B2 * 10/2008 Owens ..... A47C 7/42 29/434
7,438,362 B2 * 10/2008 Dotta ..... A47C 7/28 297/452.52
D595,819 S * 7/2009 Davis ..... D23/309
D595,820 S * 7/2009 Davis ..... D23/309
7,568,767 B2 * 8/2009 Richardson ..... A47C 4/028 297/440.1
7,713,011 B2 * 5/2010 Orszagh ..... F16B 37/064 411/113
7,744,162 B2 * 6/2010 Griggs, Jr. ..... A47C 4/028 297/440.16
7,922,253 B2 * 4/2011 Chen ..... A47C 4/02 297/440.16
7,988,236 B2 * 8/2011 Brandtner ..... F16B 12/14 297/440.14
8,322,792 B2 * 12/2012 Chen ..... A47C 17/045 297/440.1
8,322,793 B2 * 12/2012 Chen ..... A47C 13/005 297/440.1
8,356,954 B2 * 1/2013 Koch ..... A47C 4/028 403/360
8,438,716 B2 5/2013 Brandtner
8,448,314 B2 5/2013 Brandtner
8,646,843 B2 * 2/2014 Koch ..... A47C 4/028 297/440.14
8,764,115 B2 * 7/2014 Brandtner ..... B68G 13/00 297/452.59
8,777,319 B2 * 7/2014 Brandtner ..... A47C 4/028 297/440.15
8,783,778 B2 * 7/2014 Nelson ..... A47C 13/005 403/395
D726,469 S * 4/2015 Dix ..... D6/716.2
9,028,003 B2 * 5/2015 Yeh ..... A47C 13/005 297/440.14
9,028,185 B2 * 5/2015 Eggers ..... F16B 37/122 411/178
9,309,914 B2 * 4/2016 Yuan ..... F16B 37/065
9,345,330 B2 * 5/2016 Andrade ..... B29C 65/48
9,526,342 B2 * 12/2016 Thuma ..... A47C 4/02
9,609,943 B1 * 4/2017 Lin ..... A47C 4/14
9,651,080 B2 5/2017 Eggers et al.
9,839,295 B2 12/2017 Robinson et al.
9,839,298 B2 12/2017 Stirling
10,034,554 B2 * 7/2018 Lewis ..... A47C 27/001
10,117,521 B2 * 11/2018 Lewis ..... A47C 7/54
10,188,212 B2 1/2019 Thuma et al.
10,299,606 B2 5/2019 Lewis et al.
10,327,557 B2 * 6/2019 Neil ..... A47C 7/02
10,512,338 B1 * 12/2019 Hawkins ..... A47C 19/027
10,653,248 B2 * 5/2020 Lewis ..... A47C 31/11
10,869,560 B2 * 12/2020 Gates ..... A47C 31/023
11,103,087 B2 8/2021 Lewis
11,122,907 B2 * 9/2021 Brandtner ..... A47C 5/00
11,178,973 B2 * 11/2021 Nelson ..... A47C 7/28
D957,173 S 7/2022 Brandtner et al.
D977,289 S 2/2023 Brandtner et al.
11,607,044 B2 3/2023 Brandtner et al.
11,696,644 B2 * 7/2023 Brandtner ..... A47C 17/02 297/440.23
11,849,850 B2 * 12/2023 Norton ..... A47B 83/024
D1,015,791 S 2/2024 Brandtner et al.
2003/0209934 A1 * 11/2003 Haney ..... A47C 11/00 297/440.15
2004/0041452 A1 * 3/2004 Williams ..... A47C 17/134 297/337
2004/0095000 A1 * 5/2004 Durling ..... A47C 13/005 297/188.2
2004/0212240 A1 * 10/2004 Zwezdaryk ..... A47C 15/008 297/440.1
2005/0067876 A1 * 3/2005 Dortch ..... A47C 4/02 297/440.1
2005/0225153 A1 * 10/2005 Ou ..... A47C 17/00 297/440.14
2008/0185897 A1 * 8/2008 Griggs ..... A47C 4/02 297/440.1
2009/0235451 A1 * 9/2009 Gorkin ..... A47C 17/138 5/12.2
2011/0035875 A1 * 2/2011 Brandtner ..... A47C 17/225 5/13
2011/0117355 A1 * 5/2011 Selle ..... F16B 12/20 428/223
2011/0215630 A1 * 9/2011 Grove ..... A47C 7/42 297/440.1
2012/0146364 A1 * 6/2012 Hoffman ..... A47C 1/03266 297/84
2012/0146382 A1 * 6/2012 Griggs, Jr. ..... A47C 4/028 297/440.1
2012/0204392 A1 * 8/2012 Luangphon ..... B25B 27/306 29/225
2012/0217784 A1 * 8/2012 Griggs, Jr. ..... A47C 4/028 297/440.1
2013/0147244 A1 * 6/2013 Carter, III ..... A47C 13/005 297/440.1
2013/0316123 A1 * 11/2013 Preisler ..... B32B 3/266 296/193.07
2013/0320741 A1 * 12/2013 Brandtner ..... F16B 12/22 297/440.1
2014/0103695 A1 * 4/2014 Griggs, Jr. ..... A47C 4/02 297/440.1
2014/0139000 A1 * 5/2014 Ogg ..... A47C 7/546 297/440.13
2014/0239679 A1 * 8/2014 Griggs, Jr. ..... A47C 4/02 297/183.1
2014/0375103 A1 * 12/2014 Lejcher ..... A47C 7/22 29/469
2015/0130233 A1 * 5/2015 Thuma ..... A47C 7/56 297/188.1
2015/0305504 A1 * 10/2015 Robinson ..... A47C 7/16 297/452.18
2016/0106219 A1 * 4/2016 Stirling ..... A47C 11/00 297/440.2
2019/0254440 A1 * 8/2019 Gates ..... A47C 17/86
2020/0029699 A1 * 1/2020 Brandtner ..... A47C 7/24
2021/0289941 A1 * 9/2021 Brandtner ..... A47C 7/52
2022/0071398 A1 * 3/2022 Brandtner ..... A47C 7/24

FOREIGN PATENT DOCUMENTS

CN 201504842 U 6/2010
CN 102625664 A 8/2012
CN 1556681 A 12/2014
CN 106163336 A 11/2016
CN 107638001 A 1/2018
CN 107949303 A 4/2018

(56) References Cited

FOREIGN PATENT DOCUMENTS

| | | | |
|---|---|---|---|
| CN | 207355813 | U | 5/2018 |
| CN | 108289549 | A | 7/2018 |
| CN | 108289550 | A | 7/2018 |
| CN | 112512377 | A | 3/2021 |
| CN | 115334940 | A | 11/2022 |
| JP | 2015217041 | A | 12/2015 |
| RU | 00117082 | | 10/2019 |
| RU | 00117086 | | 10/2019 |
| TW | M372678 | U | 1/2010 |
| TW | I859151 | B | 10/2024 |
| WO | WOD075405-010 | | 6/2011 |
| WO | WO2018081471 | A1 | 5/2018 |
| WO | WO2020023979 | A1 | 1/2020 |
| ZA | 202210473 | B | 1/2024 |

OTHER PUBLICATIONS

Chinese Office Action in Chinese Application No. 201980050292.0, dated Aug. 7, 2023, 51 pages (with English Translation).

FSCLJ Single Sofa Armrest Chair [online], [site visited Feb. 19, 2025]. Available from internet, URL: <https://www.amazon.com/FSCLJ-Single-Armrest-Living-Furniture/dp/B09R1QS5LC> (Year: 2025).

HONBAY Side Armrest Module for Modular Sofa [online], [site visited Feb. 19, 2025]. Available from internet, URL: <https://www.amazon.com/HONBAY-Armrest-Modular-Armrests-Sectional/dp/B08HQX5PVP?th=1>, dated 2022.

International Search Report for Application No. PCT/US2019/044000 dated Nov. 26, 2019, 4 pages.

International Search Report for Application No. PCT/US2021/22645, dated Jul. 27, 2021, 6 pages.

Sofas Chairs Recliners Sectionals [online], [site visited Feb. 22, 2022]. Available from internet URL: https://www.millersfurniture.com/why-choose-smith-brothers-berne-at-millers-furniture/ (Year: 2022).

Written Opinion of the International Preliminary Examining Authority for International Application No. PCT/US2021/022645, dated Apr. 13, 2022, 5 pages.

Australian Examination Report in Australian Application No. 2019309540, dated Jun. 19, 2025, 4 pages.

* cited by examiner

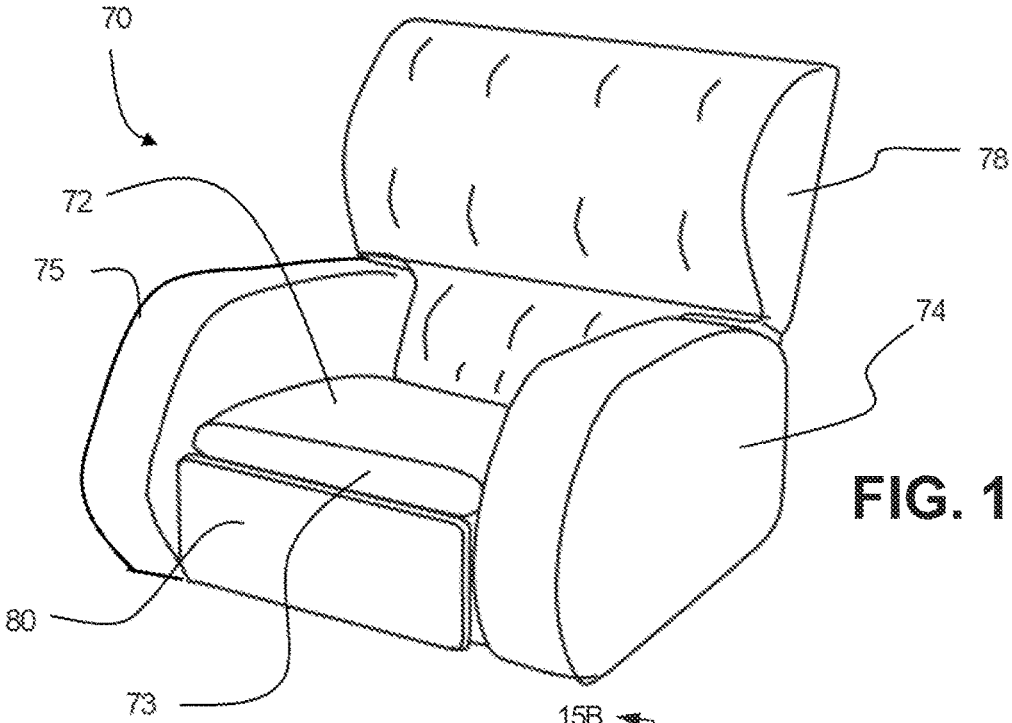
FIG. 1
FIG. 2
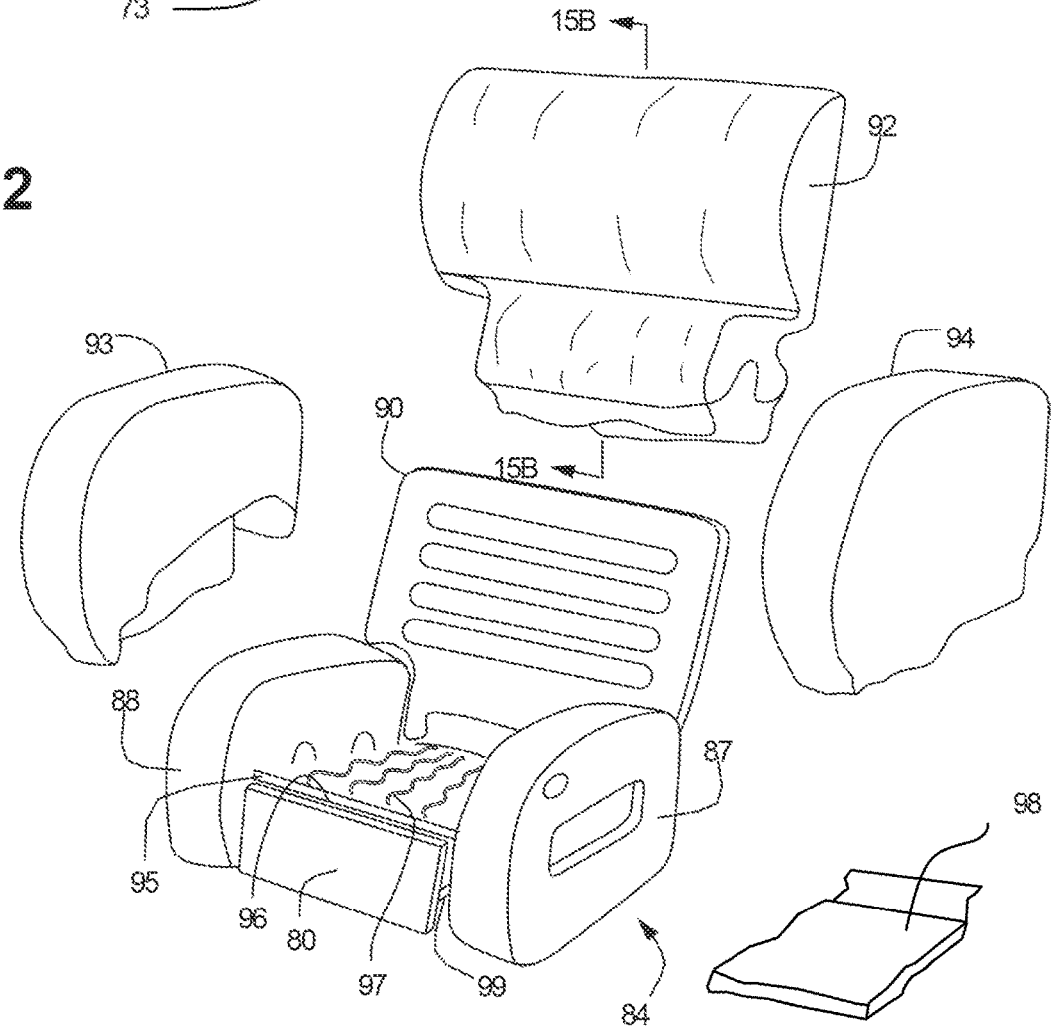

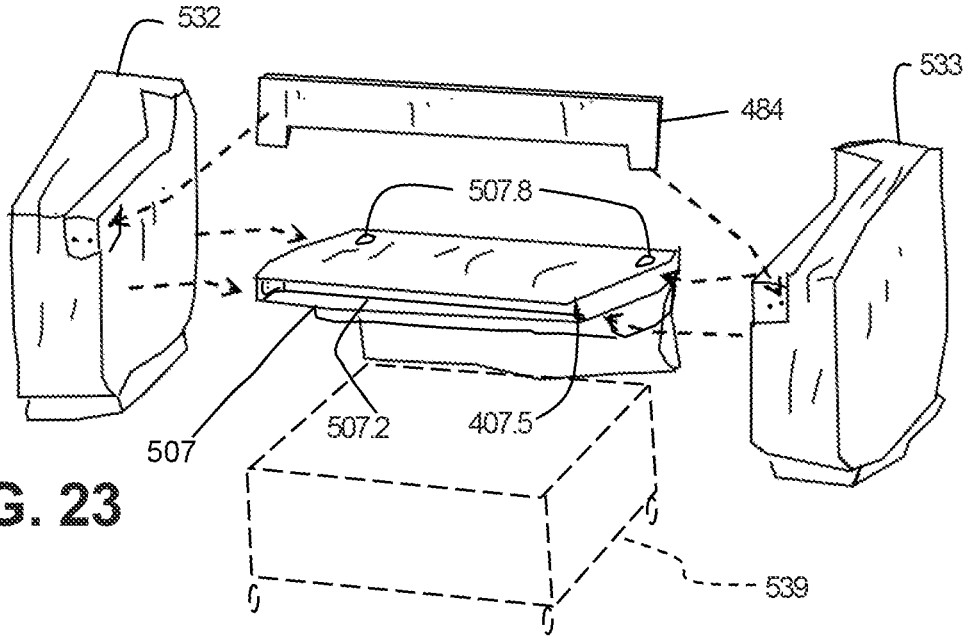
FIG. 23
FIG. 24
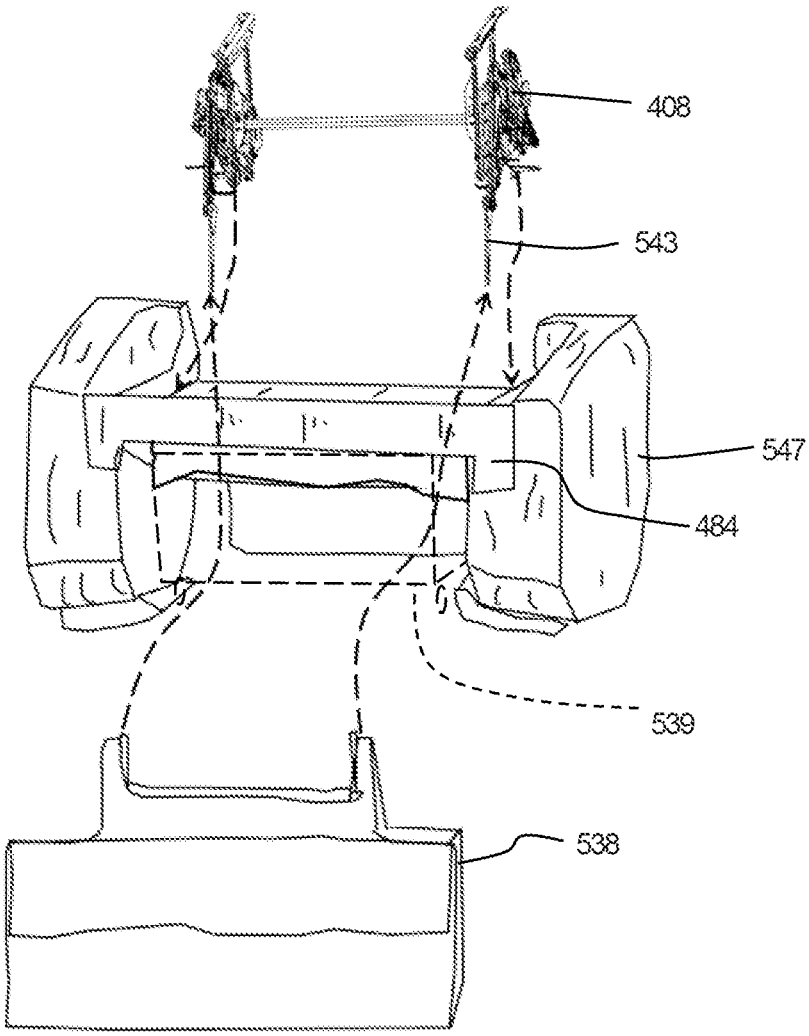

FIG. 25A
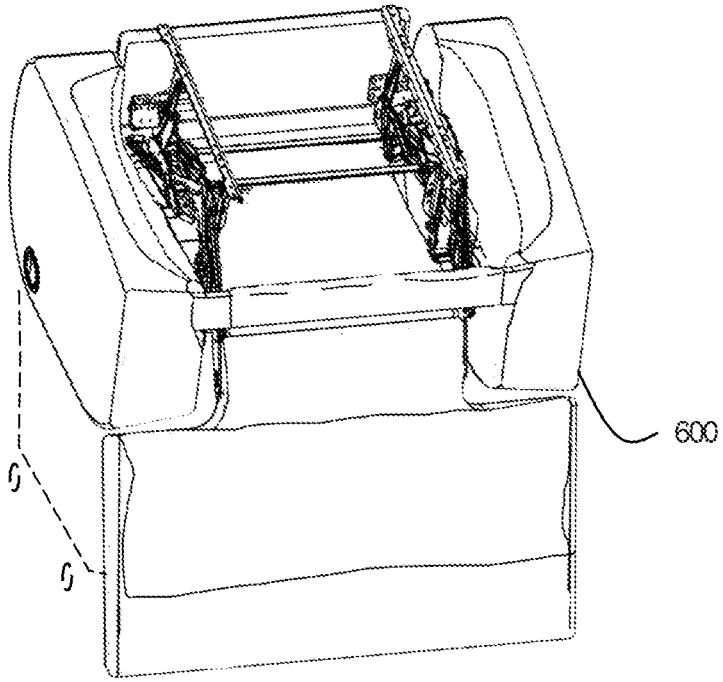
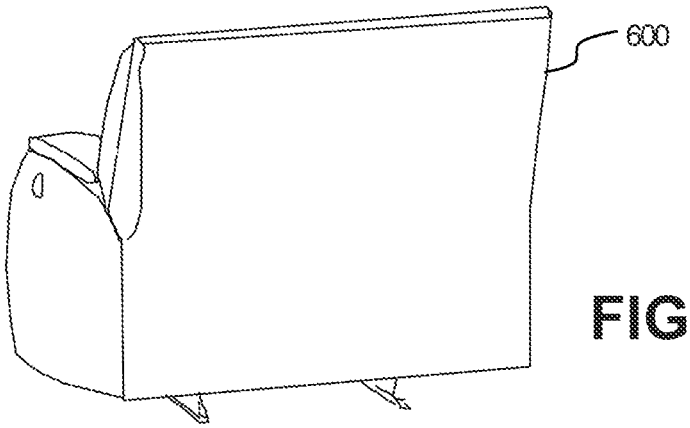
FIG. 25B

UPHOLSTERED RECLINER INCLUDING MOLDED FURNITURE COMPONENTS

This application is a continuation-in-part of U.S. patent application Ser. No. 17/481,151 filed on Sep. 21, 2021, now U.S. Pat. No. 11,696,644, which is a continuation-in-part of U.S. patent application Ser. No. 16/525,539 filed Jul. 29, 2019, now U.S. Pat. No. 11,122,907, which claims priority to U.S. Provisional Application No. 62/711,168 filed on Jul. 27, 2018; the Ser. No. 17/481,151 application is also a bypass continuation-in-part of PCT/US2021/022645, filed on Mar. 16, 2021, which claims priority to Provisional Application No. 62/990,287 filed Mar. 16, 2020. PCT/US2021/022645 also claims priority to Provisional Application No. 63/039,445 filed Jun. 15, 2020. This application also claims priority to Provisional Application No. 63/482,991 filed Feb. 2, 2023. This application further claims priority to Provisional Application No. 63/325,337 filed Mar. 30, 2022. All of said applications are incorporated by reference herein in their entireties.

FIELD OF THE DISCLOSURE

The present disclosure generally relates to upholstered furniture and, more particularly, upholstered recliners including molded forms for receiving upholstery.

BACKGROUND OF THE DISCLOSURE

Upholstered seating furniture where essentially the entirety of the exposed furniture items are covered by upholstery is one of if not the highest volume items sold in the residential retail furniture markets and thereby provides one of the highest revenue sources for retail furniture stores. The market for such upholstered seating furniture is fiercely competitive and any improvements in manufacturing resulting in an improved product, better value to the customer, and/or lower manufacturing costs are welcomed by the industry.

In the manufacture of such upholstered seating furniture items, such as sofas, love seats, recliners, and similar items, the structure for the upholstered furniture items is provided by a frame or chassis, which gives the furniture structural support and also provides its basic shape. Traditionally, frames for upholstered furniture items have been typically constructed of wood materials, such as hardwood, softwood, engineered woods (for example, plywood, hardboard, millboard, chipboard, and fiberboard). Portions of the wooden frame may typically be covered by padding or cushioning, such as foam, and then covered with fabric, leather, synthetic fabric, faux leather, microfiber, or other upholstery. Due to the large number of parts and the weight of their materials, wooden furniture frames are often heavy and have long assembly times due, in part, to the large number of parts they include. For example, a single arm alone for upholstered recliners, recliners, and sofas can include up to and over 10 or 15 different wood parts not including the multitude of fasteners, typically staples, needed for assembly. Each wood part, of course, needs to be precisely cut. Further, a single back rest for a chair or recliner can include up to and over 10 or 15 different wood parts not including the multitude of fasteners.

Additionally, attaching upholstery to the complex shape of wooden sofa frame arms also can be painstakingly tedious in that the wooden frames have gaps that need to be covered with cardboard or the like, the upholstery components, including padding, does not readily slide on the wood frame for positioning and as such, the upholstery needs to be precisely positioned by hand. Upholstery is typically painstakingly placed, manually pulled about and stapled onto wood frame members. Although staples are inexpensive and easily utilized, they are not easily removed if service of the component is needed. Any improvement in ease of attaching upholstery components to seat components, particularly allowing the easy removal, without removing staples, would be well received by furniture manufacturers.

Moreover, due to non-uniformity of wood, the use of multiple wood pieces in constructing sofa and chair components, such as arms, is only as strong as the weakest wood piece and can present difficult quality control issues. Moreover, wood pieces can crack when fasteners, are driven into the pieces during assembly of the furniture item.

The above-described process of manufacturing upholstered furniture items is time consuming and costly due to the number of parts must be manually assembled to construct the final upholstered furniture item. As such, there is a need for a simplified method for manufacturing upholstered furniture items that reduces labor and material costs while providing a product that provides a sufficient or improved level of support and comfort to the user.

Although there have been efforts to utilize plastic components in seating furniture, such efforts have not been commercially successful with regard to upholstered seating furniture and have not taken advantage of the respective attributes and disadvantages of plastic and wood.

With respect to recliners, the incorporation of the recliner mechanism, whether motorized or non-motorized, into the framework of the recliner requires secure structural support of the recliner mechanism above the floor, allowing the recliner mechanism to movably support the recliner components such as the back rest, the footrest or ottoman, the seat, and the arm rests. The presence of the recliner mechanism and the cooperation of the various parts make assembly of recliners more tedious and challenging than sofas or a chair with no moving components. Applying upholstery to such recliners is also more challenging due to the relative movement of the components with respect to each other. Moreover, the wood frame of recliner components are more challenging to construct than sofas or non-moving seats in that the individual components that move with respect to other components have to be structurally strong and independent. That is, for example, the back rest moves with respect to the seat and arm rests so it cannot be immovably attached to the seat and armrests and therefore must be structurally independent, attached only to the recliner mechanism. Constructing these components of wood and steel parts is tedious and challenging.

Any improvements in recliner construction methods that simplify the manufacture and that make the manufacturing less labor intensive and would be welcomed by the furniture industry and result in lower costs to the manufacturers and to the purchasing public.

SUMMARY

The embodiments of the present disclosure include upholstered seating furniture in which the number of components that need to be assembled is minimized, in which the assembly is simpler, where the time for assembly is minimized, and where the finished product is robust and sturdy.

In embodiments, molded polymer forms, formed such as by blow molding, provide a pair of arm rests and a back rest for a seat. In embodiments, the seat is a recliner and comprises a seat deck with a steel frame fastened to and positioned between a pair of polymer arm rest forms, a recliner mechanism positioned below the seat deck and secured to the seat deck, a polymer back rest form with a pair of brackets secured to the exterior wall surface of the polymer back rest form, the pair of brackets attached to upwardly extending connection posts of the recliner mechanism. In embodiments, the recliner mechanism having forward rearward rails through which the recliner mechanism may engage the floor surface through floor engaging feet attached to the two rails.

In embodiments, each of the arm rest forms and the back rest forms have form fitting upholstery covering enclosures, with an open end and a closed end with a continuous upholstery forming a loop in cross-section therebetween, may urged over the form before assembly of the forms into a seat such as a recliner. The covering enclosures may have zippers and/or hook and loop cooperating portions at the open end to close or partially close the upholstery sack upon receiving the respective forms. In embodiments, the seat deck comprises a metal frame peripheral frame and seat springs supported by the peripheral frame. The seat deck may be inserted into an upholstery covering enclosures that is sized and form fit to tightly receive the seat deck. The seat deck upholstery covering enclosure may also have a forwardly extending flap with a pocket for a footrest or ottoman insert. Each of the upholstery covering enclosures are formed of different material panels sewn together. Some of the panels comprising the main exposed upholstery, and, for example, other panels comprising material positioned at the bottom side of the seat that will not be exposed in normal usage of the seat. Additionally, the upholstery covering enclosures may include pillow compartments that will be positioned on the arm rest forms, or the seat deck, or the front of the back rest form.

In embodiments, each of the polymer arm rest forms have a continuous exterior wall that has an outer surface and an inner surface, the inner surface defining an interior of the arm rest form that is separated from space on the exterior of the arm rest form by the continuous exterior wall. The inner surface of the exterior wall meeting the outer surface of continuous wall at openings provided in the forms. Such openings being provided for, for example, attachment of fasteners or for insertion of reinforcing components into the interior of the forms.

In embodiments, the back rest form has two lower hollow legs to which the pair of brackets are secured, and wherein a pair of elongate wood inserts, metal inserts, or polymer inserts, are positioned in the interior of the back rest form in the lower legs and extend upwardly to a back receiving portion of the back rest form, each bracket being secured to the respective elongate wood insert by one or more fasteners such that the wall of the back rest form is sandwiched between the bracket and the elongate wood insert clamping the wall of the back rest form therebetween and providing structural strength and support to the back rest form. The back rest form has, relative to its arrangement on a seat, a front side, a rearward side, a bottom side, a top side, and two lateral sides with a periphery portion extending continuously around the top side, a lateral side, a bottom side, the other lateral side. A plurality of openings defined by the exterior wall of the back rest form such that openings or windows extend through the back rest form between the front and rearward side, the plurality of openings defining pillars and/or cross beams within and connecting to the peripheral portion of the back rest form. A feature and advantage of embodiments is that the pillars and/or cross beams provide strengthening of the back rest form.

In embodiments, there are no elongate inserts, kd brackets are clamped to each of two downwardly extending legs of the backrest form with barrel nuts and screws that compress wall structure unitary with the walls of the backrest form.

In embodiments, each of the arm rest forms have a continuous exterior wall that has an outer surface and an inner surface, the inner surface defining an interior of the arm rest form that is separated from space on the exterior of the arm rest form by the continuous exterior wall. The inner surface of the exterior wall meeting the outer surface at openings into the interior. The back rest form has, relative to its arrangement on a seat, an inward side, an outer side, a front side, a rearward side, a bottom side, and a top side. An enlarged ring portion extending continuously around the top side, the front side, the bottom side, and the rearward side of each arm rest form. A plurality of openings defined by the exterior wall of the arm rest form such that openings or windows extend through each arm rest form between the inward side and the outward side, the opening defining one or more columns of the plurality of openings defining pillars and/or cross beams within and connecting to the peripheral ring portion of the arm rest form. The pillars generally having a tubular configuration extending between upper and lower portions of the ring portion defining the periphery of the arm rests. A feature and advantage of embodiments is that the pillars and/or cross beams provide structural strengthening of the arm rest forms and the columns provide a convenient strength enhanced portion of the arm rest forms for attachment of support plates or other connection means. In embodiments, a recess of the wall portion extends inwardly on the outer side of each arm rest form portion radially inward of the peripheral ring portion of each arm rest form. The recess provides a recess portion that increases the surface area of the wall and with the added wall "structure" and enhances the strength of each of the arm rest forms.

In embodiments, the seat configured as a recliner may be assembled with the upholstery attached to the arm rest forms, the seat deck, and the back rest form before assembly of the recliner. A U-shaped spanning member such as a wood spanning member, extends between the two arm rest portions and is attached with screws that extend through the spanning member into threaded fasteners anchored to rearward walls of the respective ones of the pair of arm rest forms. The spanning member, including legs of the U-shaped member are received in conforming recesses at the rearward side of the arm rest forms for positionally stabilizing the two arm rest forms with respect to one another. The upholstery covering enclosure for the arm rest forms when in place on the arm rest forms are appropriately open, at the rearward end of the arm rest forms permitting the attachment of the U-shaped spanning member.

The arm rests may be attached to the seat deck with screws extending through the peripheral frame of the seat deck, through the two walls of the respective arm rest form and into a threaded fastener configured as a nut integrated with or unitary with a plate positioned on the exterior surface of the respective arm rest form on the outer side of the arm rest form. Additional screws may extend through a portion of the seat deck frame on a rearward end of the frame, for example a pair of welded on plates into threaded fasteners, with interior threads, secured in the wall proximate the rearward side of the polymer arm rest forms. Preformed openings in the upholstered covering enclosure may provide access to the attachment points, typically holes, in the seat deck frame, for attachment to the arm rest forms. The recliner mechanism may be secured to the combined upholstered arm rest forms and upholstered seat deck by placement of screws extending through holes in portions of the recliner mechanism into the seat deck frame, for example four screws. The screws may be received in threaded portions, such as integral nuts, or may be self-tapping screws. A forward flap of the seat deck upholstery covering may include the footrest form which may now be attached to the ottoman links of the recliner mechanism such as by four screws. The recliner mechanism has upwardly extending back rest receiving posts (when in the use position) that receive the brackets attached to the back rest form. Following the attachment of the recliner mechanism to the seat deck, the brackets of the back rest with upholstery covering enclosure thereon may be connected to the back rest receiving posts such as by sliding the cooperating brackets of the back rest onto the arm rest receiving posts. This essentially completes the assembly of the recliner.

A feature and advantage of embodiment of recliners is that upholstery kits that provide upholstery covering enclosures for the arm rest forms, the back rest form, and the seat deck may be manufactured at one advantageous location and then shipped to a final assembly location of the seat. Additionally, the component forms may be molded or assembled at one location and shipped to the final seat assembly location. A feature and advantage of embodiments is that the entire seat, configured as a recliner, may be assembled at one location by sliding on upholstery covering enclosures onto the arm rest forms, the back rest forms, and the seat deck; the arm rest forms with the upholstered covering enclosures thereon may be attached to a seat deck frame with the upholstered covering enclosure thereon; a recliner mechanism may be attached to the seat deck frame, and the back rest form with the upholstery covering enclosure thereon may be attached to the recliner mechanism essentially completing assembly of the recliner in minutes.

A feature and advantage of embodiments of the seat being a recliner, the connection of the arm rests forms, the seat deck, the recliner mechanism are all by way of screws. A further feature and embodiment is that all upholstery is attached to the arm rest forms, the seat deck, and the back rest forms before assembly of the recliner. In embodiments, no staples are needed for attachment of the upholstery coverings.

A feature and advantage is a recliner that is quickly assembled and that can be disassembled by removing screws for repair of the recliner or for replacement of the upholstery.

The inventors have identified an optimal and synergistic use of polymer structural components and non-polymer structural frame components, such as wood frame members, and steel framed members, to provide such attributes.

A feature and advantage of embodiments is that the inventors have discovered that seat box frames can be effectively attached to blow molded arm rest forms by clamping a wall or pair of walls between metal clamping portions by using fasteners known as rivet nuts or by using metal brackets and threaded fasteners to clamp or sandwich the polymer wall or walls at the support locations.

In embodiments, wood frame members or metal framed components attach to blow molded forms by way of a plurality of metal screws extending into a plurality of metal threaded inserts in the respective blow molded forms. In embodiments the threaded metal inserts pinch the wall of the respective blow molded form and provide a non rotatable nut with internal threads to receive a screw. In embodiments, the threaded metal insert is positioned in a metal plate or a wood plate that is attached or placed on an exterior wall surface of a blow molded form. Such inserts may be T-nuts with prongs that embed into the exterior surface of the substrate to which they are attached or rivet nuts that clamp onto the substrate wall.

The upholstery covering the side arm rest forms, the back rest, and the cushions such that substantially the entirety of the exposed regions of the sofa are covered by the upholstering.

A feature and advantage of embodiments is a furniture item including a pair of opposing arm member forms each unitarily formed from a single piece of polymeric material. This structural arrangement provides ease of assembly and cost efficiencies by minimizing the number of parts and minimizing the number of assembly steps. In embodiments, wooden or metal crossing members extend between the pair of opposing arm member forms. In embodiments, each arm member defines a plurality of corresponding recesses, each of the corresponding recesses being dimensioned and positioned to receive an end portion of a cross members. In embodiments, a plurality of threaded metal inserts are supported by each of the arm rest forms. Each of the threaded metal inserts may receive a threaded fastener that aids in constraining a wooden cross member relative to the arm member. The threaded metal inserts may clamp onto the polymeric wall where they are inserted.

A feature and advantage of embodiments is a pair of mirror image or substantially similar mirror image blow molded polymer arm rest forms each having a plurality of horizontal through openings. The through openings providing enhanced structural integrity and may facilitate attachment of upholstery and other components, such as plates with nuts, and controls for motorized recliner mechanisms.

A feature and benefit of embodiments is an upholstered furniture item have covering material in the form of an upholstery socks, one positioned over a polymer molded form for the back rest, one for each of the arm rest forms. An additional sock can be assembled over a seat deck. The socks can be closed or substantially closed or partially closed after inserting the polymer forms or the seat deck. A "sock" when used herein generally means a form of flexible material that is conformingly sized to the form or structure to be inserted therein and where the form then covers a substantial portion of or most of or generally all of the form or structure. by zippers or hook and loop material or other fasteners. In embodiments, the upholstery sack includes padding that provides a higher level comfort for users of the upholstered furniture item. In embodiments, the upholstered furniture item further includes a padding, wherein at least a portion of each of arm portions is covered by the padding, such that the pad is intermediate the molded component and covering material. In embodiments, the upholstery socks may have openings, for example holes approximately one to three inches in diameter, where access to threaded fastener connection regions may be accomplished.

A feature and advantage of embodiments is a furniture item including a pair of opposing arm rest forms members, each of the arm members comprising a hollow body comprising a polymeric wall that extends continuously about a top side, two lateral sides, a forward side, a rearward side, and a bottom side. In embodiments the wall does not have an exposed edge of the wall thickness other than at threaded fastener connection locations. The wall having an inward facing surface defining an interior with a void volume. The interior and void volume extending from a top side wall portion, two lateral side wall portions, a forward wall portion, a rearward wall portion, and a bottom wall portion. In embodiments, the continuous wall substantially defines an enclosed interior. In embodiments, the void volume is greater than about 1 $ft.^3$ and less than about 3.5 $ft.^3$.

In embodiments the polymeric arm rest forms have an outer wall surface having low coefficient of friction with respect to receiving upholstery coverings. In embodiments, the low friction polymeric outward facing surfaces provided by the polymeric shell wall facilitate the pulling of upholstery covering materials over the arm portions of the furniture item. The exterior surface having less of a coefficient of friction with respect to wood frame members. In embodiments, the polymeric wall gives structural support and also provides a fundamental shape to the arm portions of the furniture item. In embodiments, the polymeric wall has structure defining recesses and slots. The recesses and slots can be sized to receive frame members. In embodiments, the wall portions defining the recesses and or slots can provide an interference fit on opposing sides of the frame member. A feature and advantage of embodiments is with such an interference fit the exterior surface of the wall portion at the recess engages an exterior surface of the frame member, which may be wood, and provides a relatively high coefficient of friction that may effectively retain the frame member within the recess or slot.

A feature and advantage of embodiments is a furniture item including an arm portion integrally formed from a single piece of thermoplastic material. This arrangement allows the arm portion body to be fabricated using an automated and efficient thermoplastic injection molding processes.

A feature and benefit of embodiments is a furniture item including an arm member having cross member receiving recesses that orient wooden cross members of the furniture. In embodiments, each of the cross member receiving recesses is shaped and dimensioned to receive an end portion of a wooden cross member while the wooden cross member is disposed in a predetermined orientation relative to the arm member. In embodiments, the arrangement facilitates fixture-less alignment and assembly of the subcomponents.

A feature and advantage of embodiments is a recliner which, compared to conventional recliners, the number of components needed to assemble the recliner is greatly reduced, the difficulty of assembly is greatly reduced, the time of assembly is greatly reduced, and the expense is correspondingly greatly reduced. Moreover, the structural integrity is generally greater.

A feature and advantage is that the inventors have discovered that utilizing certain polymers, such as polyethylenes, can received staples comparable to wood frame members. This facilitates utilization of the polymer arm rest forms in existing furniture assembly lines.

A feature and advantage of embodiments, a blow molded arm rest form may have a nominal wall thickness of from 2 to 6 mm. This thickness provides stabilization and secure holding of frame components connected thereto, while providing an arm rest form that is more resilient that a prior art wooded arm rest frame. In embodiments, the top wall portion of the arm rest form may be deflected more than 0.5 inches under loading, for example under a 100 lb. loading of a hand or foot of a person and will return to the original position when the loading is removed, the arm rest form is not damaged. In embodiments, the top wall portion of the arm rest form may be deflected more than 0.75 inches in localized regions under loading, for example under a 100 lb. loading of a hand or foot of a person, and the localized region of the top wall will return to the original position when the loading is removed, the arm rest form is not damaged. In embodiments, each of the top side wall portion, the two lateral side wall portions, the forward side wall portion, the rearward side wall portion, and the bottom side wall portion may be deflected 0.5 inches and each said side will return to the original position without damage. In embodiments, each of the top side wall portion, the two lateral side wall portions, the forward side wall portion, the rearward side wall portion, and the bottom side wall portion may be deflected 0.75 inches and each said side will return to the original position without damage. In embodiments, each of the top side wall portion, the two lateral side wall portions, the forward side wall portion, the rearward side wall portion, and the bottom side wall portion may be deflected 1.0 inches and each said side will return to the original position without damage. Such resilience can reduce the amount of cushioning material needed compared to conventional wood framed arm rest form and can provide an increased measure of safety over a wood framed arm rest when, for example, an individual inadvertently collides with or falls onto the arm rest.

A feature and advantage of embodiments is that the pair of blow molded arm rest forms each have a rearward face of a significant area to interface with the lower rearward rail or cross member and a defined recess in the face to receive end portions of the rail or cross member. These interfaces provide a high degree of rigidity to position the arm rest portions and in a precise rectangular geometry when initially assembled and secure that rectangular geometry during assembly, transportation, and ultimately use for the life of the recliner.

A feature and advantage of embodiments is the entire laterally outward wall surface of each polymer arm rest form is comprised of a single unitary closed wall with minimal apertures extending through the wall to the interior of the form. The apertures positioned at fastener locations for securing the arm rest form to another component. A feature and advantage of embodiments is the entire laterally inward wall surface of each polymer arm rest form is comprised of a single unitary closed wall with no apertures extending through the wall except associated with attaching other components.

A feature and advantage of embodiments of blow molded polymeric arm rest forms and a back rest form is that each may have one wall, the inner wall joining the outer wall at junctures interior a periphery of the blow molded form. These junctures can be at openings or windows defined in the blow molded form or at locations where no opening extend through the blow molded form A feature and advantage of embodiments, a seat with a pair of blow molded arm rest forms may have a nominal wall thickness of from 2 to 3.5 mm, where the vertical walls or upper walls of the arm rest forms do not carry the majority of the loading of persons or pets on the seat. Rather the loading bypasses the vertical walls or upper walls of the arm rest forms and pass through other structural members. A feature and advantage of embodiments, a blow molded arm rest form may have a nominal wall thickness of from 2 to 3.5 mm, where upright portions of the arm rest form do not carry the majority of the loading of persons or pets on the seat.

In embodiments, attachment of the upholstery is simplified by the very low coefficient of friction between the sofa arm form and the upholstery material, allowing conformingly sized upholstery arm portion, such as socks, to be readily slid over the arm forms. In embodiments, this facilitates construction of more complete upholstery kits at locations remote from the final sofa assembly site of the sofa. For example, upholstery kits can include arm rest sock portions that already have arm rest padding attached to the upholstery covering material. This can eliminate the steps of manually having to attach one or more layers of padding at the final sofa assembly site before attaching the arm rest upholstered portions. Back rest forms similarly may have upholstery coverings with padding or recesses for padding sewn and assembled at a remote location with the coverings shipped to an assembly location of the seat.

A feature and advantage of embodiments is that segregation of manufacturing sites for components of the upholstered seating furniture items is enhanced. For example, padding for arm rests can be attached to arm rest upholstery portions as part of an upholstery kit in remote locations from the final seating furniture assembly location. Additionally, the arm rest forms may each be molded at a location remote from the final seating furniture assembly location and transported to the final seating furniture assembly location.

A feature and benefit of embodiments is an arrangement for furniture items in which the number of components that need to be assembled is minimized, is simple to assemble and the time for assembly is minimized and is robust and sturdy.

A feature and advantage of embodiments is a recliner where the arm rests are supported exclusively by a seat deck frame facilitating application of a form fit upholstery covering attached and secured with a zipper and no staples. A feature and advantage of embodiments is a form fit upholstery cover that attaches to a back rest form without any staples. A feature and advantage of embodiments is a form fit upholstery covering for a seat deck that is attached to and secured without any staples. In each of these upholstery coverings, removal and repair or replacement is much easier that conventional recliners, and assembly steps are quicker, less labor intensive, less prone to quality control issues.

A feature and advantage of embodiments is that the specific attributes of polymers and wood have been combined in a synergistic fashion for construction of a chassis for upholstered seating furniture. For example, conventional polymers suitable for geometrically large components, such as furniture components, for example polyethylenes, when subjected to tensile loading or significant sheer loading may creep over time and may lose load carrying strength and may effectively collapse. Although, three-dimensional polymer forms, particularly hollow polymer forms have reasonable compressive load carrying capabilities depending on loading. That is downward weight loading will not generally cause noticeable creep of the polymer making certain polymers such as polyethylenes suitable for arm rest forms.

The inventors have discovered that a thin walled blow molded arm rest may be supported off of the floor surface by a conventional recliner mechanism utilizing vertical columns formed by the thin wall of the arm rest form. The bracket providing ample support and strength in connecting the arm rest form to a metal framed seat deck using a reinforcing plate attached to the exterior side of the arm rest forms at the column, and having a threaded connector, such as a bolt, extending from the seat deck through the arm rest form and connecting with the reinforcing plate. In embodiments of the invention, no loading from seating is isolated on the polymer arm rest forms, rather the loading is carried directly downward from the seat deck to a recliner mechanism to the floor. That is the seating loading does not extend through the polymer arm rest forms to the floor surface. The recliner mechanism may have floor engaging feet.

A feature and advantage of embodiments is that a spanning wood frame member extends between and is attached to a pair of spaced hollow polymer arm rest forms, each end of the spanning wood frame member received in a form fit recess that abuts the edge surface and rear face of the spanning wood frame member.

A feature and advantage of embodiments are blow molded polymer arm rest forms that have a plurality of through openings defining on or more vertical columns in the arm rest forms in the wall portions for adding structural strength to the arm rest form. One such column receiving a plate for connection of the seat deck assembly. A feature and advantage of embodiments are blow molded polymer back rest forms that have a plurality of through openings defining one or more columns and horizontal beams in the back rest forms in the wall portions for adding structural strength to the back rest form.

A feature and advantage of embodiments is use of a polyethylene for arm rest forms, and with threaded inserts having an internal threaded surface placed at spanning member attachment points in polymer wall portions for receiving screws that extend through spanning frame members for securing the spanning frame members to the polymer arm rest forms. In embodiments, the threaded inserts have an external thread and are threaded into the polymer wall portions of the arm rest forms. In embodiments the spanning member attachment points are at recesses in the wall portions of the arm rest forms whereby an end of the spanning member will nest into the recess, the nesting providing secure fixation of the component with respect to the arm rest forms.

A feature and advantage of embodiments is a polymer arm rest form that has an exterior surface that is deflectable throughout the surface upon impact that is greater than any deflection of a conventional wood arm rest frame. In embodiments, all exterior corners of the polymer arm rest form have a radius of 0.5 inches or greater defined by the curvature of a corner wall portion providing deflection upon impact and a more blunt impact corner than conventional wood frame arm rest forms. In embodiments, all exterior corners of the polymer arm rest form defining the profile of the arm rest form have a radius of 0.75 inches or greater defined by the curvature of a corner wall portion.

In embodiments of the invention, arm rests for a stationary upholstered seating item such as a recliner, each have a hollow polymer arm rest form weighing from about 6 to 10 lbs, saving 10 to 16 pounds for both arm rest forms compared to conventional wood framed arm rest forms. In embodiments of the invention, recliner arm rest forms can save 14 to 19 pounds for two blow molded arm rests compared to conventional wood framed arm rest forms. In recliners, a 50% reduction in the weight from the arm rests is available by using blow molded polymer arm rest forms over conventional wood framed arm rests.

In embodiments of the invention, the inventors have facilitated utilizing hollow thin-walled, blow molded structures, such as chair arm rests, in load carrying applications by providing reinforcing means to the blow molded structures. Such reinforcing mean including metal or wood plates, or beams inserted into receiving pockets formed in the blow molded structure. In embodiments, the plane of a plate is positioned upright in a pocket defined in the blow molded structure for enhancing the load carrying capability. In embodiments, a hollow blow molded structure has a wood or metal reinforcing plate or beam on one lateral side of the blow molded structure and has another metal or wood load carrying structure on an opposite lateral side of the blow molded structure.

In embodiments, a blow molded back rest form, such as for a recliner, can have metal reinforcing arms inserted within the blow molded back rest form that attach to metal couplings for connecting with the recliner mechanism. The wall of the blow molded back rest form may be sandwiched and compressed between the metal coupling and the reinforcing arms.

In embodiments, a recliner may be efficiently and quickly assembled utilizing preformed blow molded arm rest forms and preformed blow molded back rest form, and a conventional recliner seat base with a generally rectangular frame, and a conventional recliner mechanism that is attached below the seat base frame. In embodiments, metal female threaded fasteners are secured to or in the arm rest forms. And metal attachment brackets are secured to the back rest form. Form fitting upholstery coverings are attached separately to each of the four components. The arm rest forms are bolted to the seat base, a recliner mechanism is bolted to the assembled seat base and arm rest assembly, and the back rest is attached to extending bracket receiving prongs of the recliner mechanism.

The above summary is not intended to describe each illustrated embodiment or every implementation of the present disclosure.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

FIG. 1 is a perspective view of an upholstered recliner in accord with embodiments.

FIG. 2 is a partial exploded view of the recliner of FIG. 1 with the upholstery coverings removed revealing the assembled recliner frame formed of a pair of arm rest forms, a seat deck, and a back rest form.

FIG. 23 is an exploded view illustrating the assembly of the upholstery covered seat deck to the upholstery covered arm rest forms and a jig for the further assembly of the recliner.

FIG. 24 is an exploded view illustrating the assembly of the recliner mechanism to the seat deck-arm rest forms on the jig, and the assembly of the upholstered seat back to the recliner mechanism.

FIG. 25A is a perspective view of an assembled recliner on the assembly jig.

FIG. 25B is a perspective view of the assembled recliner flipped over.

Figure 3:
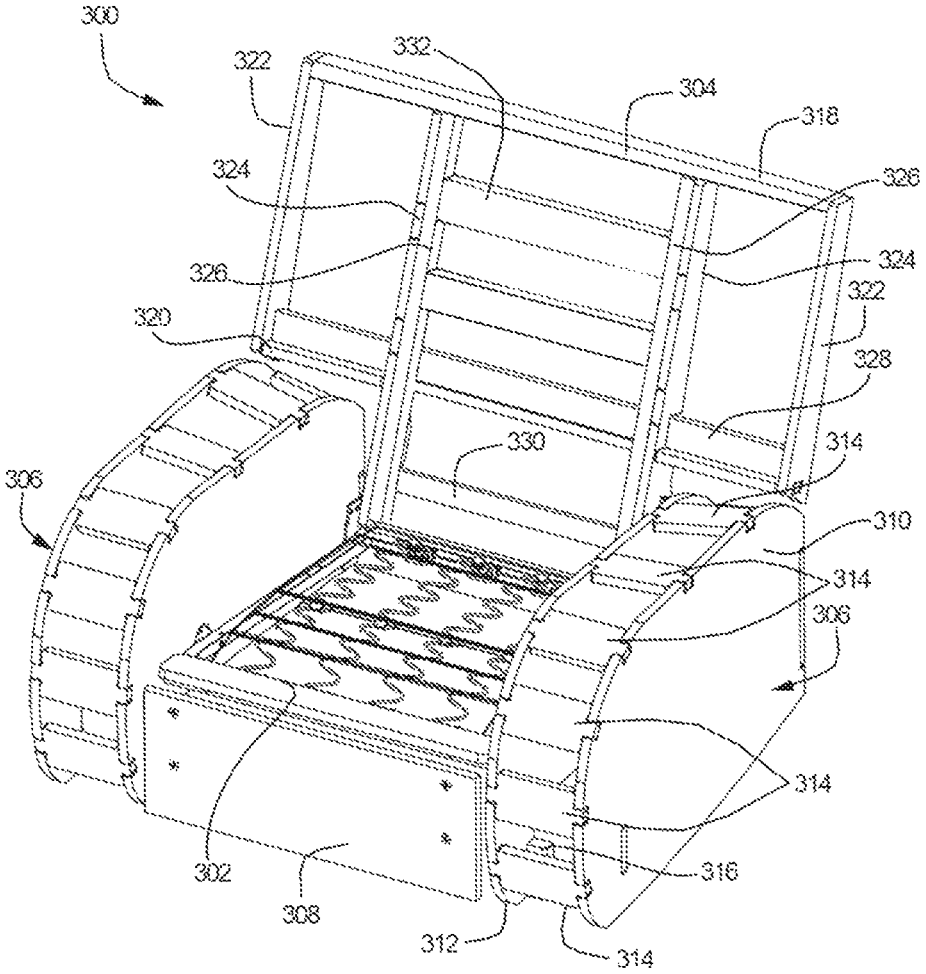
FIG. 3 Prior Art
FIG. 3 is a perspective view of a PRIOR ART recliner frame not including any molded plastic components.
Figure 4:
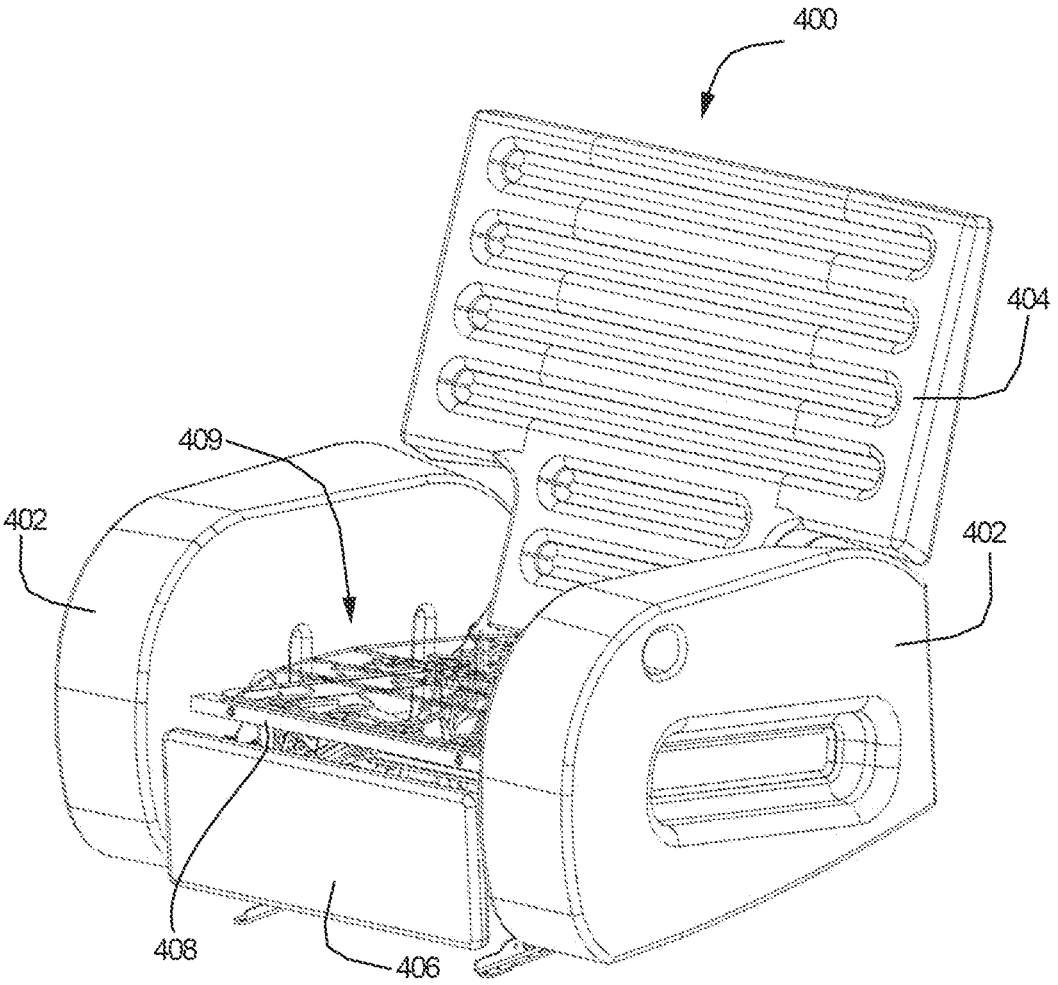
FIG. 4 is a more detailed perspective view of a recliner frame with a seat deck and recliner mechanism and a molded back rest form and two molded arm rest forms.

While the embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Referring to FIG. 1, an upholstered recliner 70 has a seat 72 with a seat cushion 73, a pair of arm rests 74, 75, a back rest 78, and a footrest 80. Referring to FIG. 2, the recliner further has a recliner frame 84, comprising a pair of polymer arm rest forms 87, 88 and a back rest form 90. The arm rest forms and back rest form are each unitary and molded such as by blow molding. Upholstery coverings on the frame include a back rest upholstery covering portion 92 and side arm covering portions 93, 94, each conformingly sized for the respective form. The frame further includes a seat deck 95, which may include frame members 96 and metal springs 97. A recliner mechanism 99 is positioned below the seat deck. A seat deck upholstery covering portion 98 is conformingly sized for the seat deck. In embodiments, upholstery for the sofa and recliner may be furnished as a kit, the kit manufactured at a location remote from a final assembly location of the sofa. When used herein, "portion" may be all of or part of something. Portion is not to be considered as limiting.

Arm rest forms 87, 88 can be formed of by molding methods, such as blow molding (injection blow molding, extrusion blow molding, injection stretch blow molding), including with more than one parison, and formed of different materials including, by way of example, polyethylene (PE), such as high-density polyethylene (HDPE) and low-density polyethylene (LDPE), polyvinyl chloride (PVC), polypropylene (PP), nylon, and polyethylene terephthalate (PET), thermoplastic elastomers (TPE), acrylonitrile butadiene styrene (ABS), polyphenylene oxide (PPO), nylon/polyamides (PA), polycarbonate (PC), polyester and copolyester, urethane and polyurethane, and acrylic and polystyrene. In other embodiments, molded components can be formed by differing molding methods, such as injection molding (overmolding, insert molding, cold runner injection molding, hot runner molds) and rotational molding.

Figure 5:
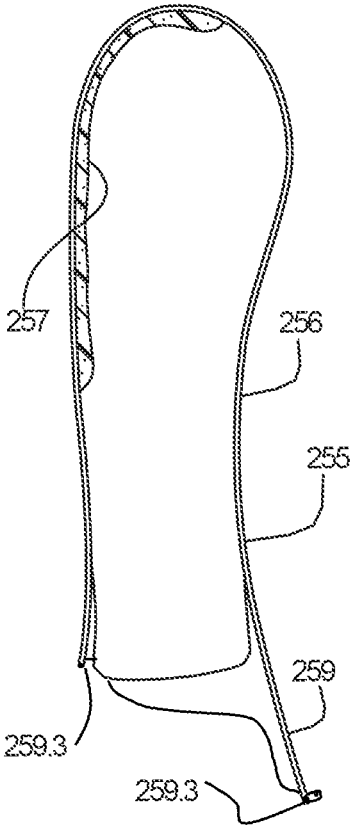
FIGS. 5, 6, and 7 are cross sections of exemplary upholstery coverings for receiving an arm rest form and a back rest form.
Figure 6:
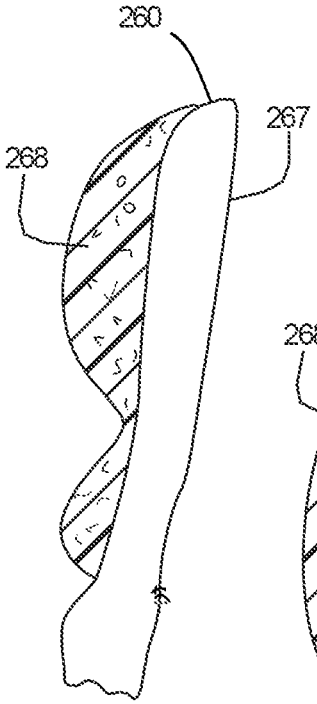
Figure 7:
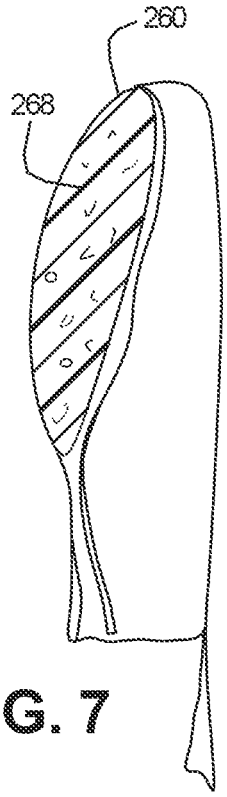
Figure 8:
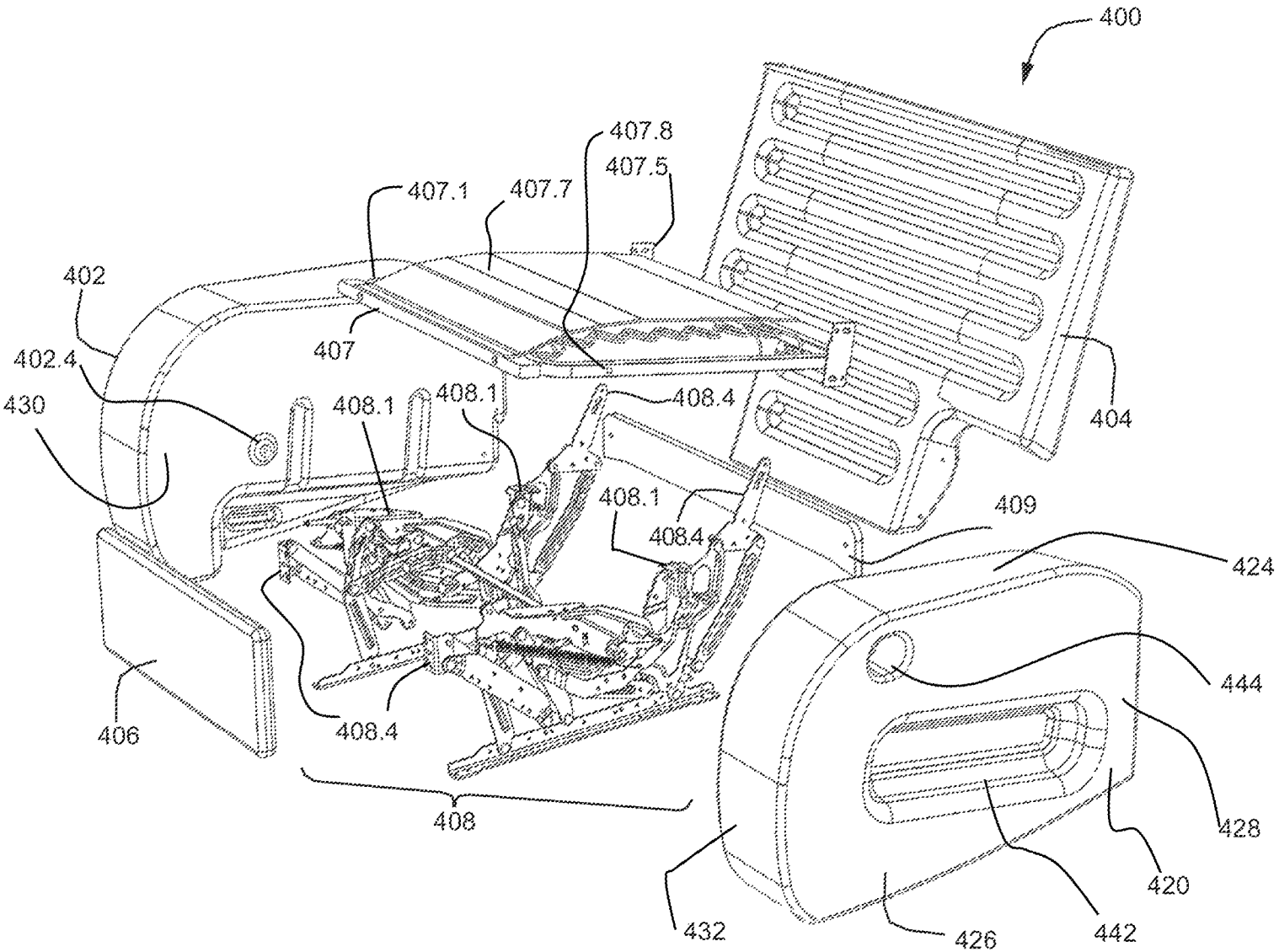
FIG. 8 is an exploded view of the recliner components of FIG. 4.
Figure 9:
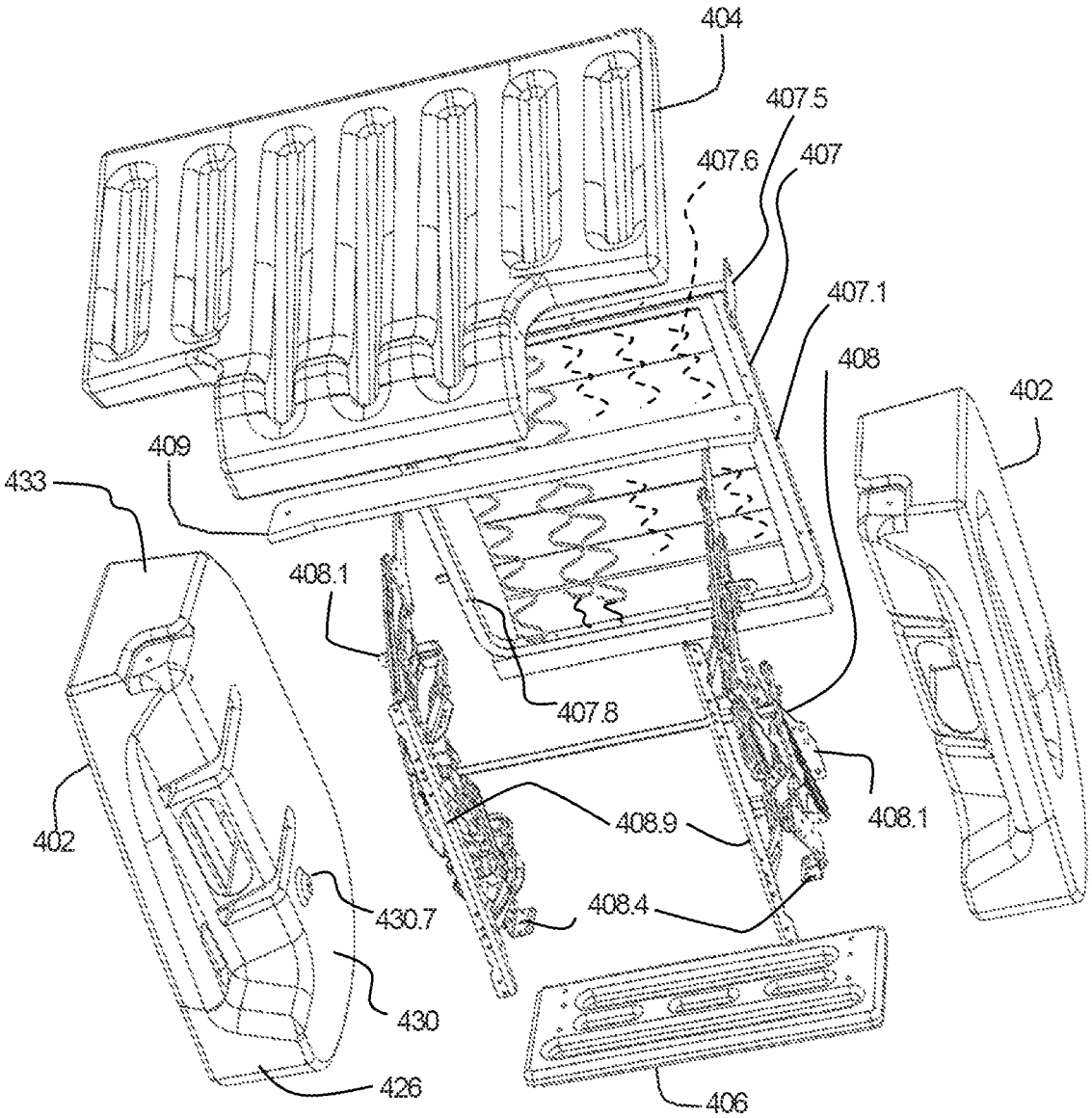
FIG. 9 is a rearward exploded view of the recliner of FIG. 4.

Referring to FIGS. 2 and 5, in embodiments, arm rest forms can be covered by upholstery configured as a form fitting upholstery sock 255 with a close conforming shape to the arm rest form 68. Integrated on an inner surface of the upholstery material 256 is a layer of padding material 257. The upholstery sock with padding may be slid on the arm rest form without needing padding attached to the arm rest form beforehand. A zipper 259.3 can close or substantially close the open end of the upholstery sock for retention of the upholstery sock on the arm rest form. Referring to FIGS. 6 and 7, an upholstery sock 260 may be conformingly sized to the back rest form and have padding 268 integrated therein. A back panel 267 of upholstery material extends over the back side of the back rest form with no padding. See also the discussion below with reference to FIGS. 19-23, describing installation of the upholstery socks before assembly of the main components of the recliner, namely, the arm rest forms, the seat deck, the recliner mechanism, and the back rest form.

The back rest upholstery portion, the arm rest upholstery portions, and the base upholstery portions are depicted as separate upholstery components to be attached to the recliner frame, in embodiments they may be combined in one or more integrated upholstery covering with the separate portions connecting prior to installation on the recliner frame Referring to Prior Art FIG. 3, a prior art structural frame 300 for a recliner is depicted. Certain portions of frame 300 once assembled, such as arms portions, can be covered by cardboard or fiberboard for providing further shape and, further, can be covered by padding or cushioning, such as load poly, arm fiber, and/or foam, and can then covered with fabric, leather, synthetic fabric, faux leather, microfiber, or other upholstery or covering materials. As depicted, prior art recliner frame 300 generally includes a seat box 302, a back rest form 304, two arms 306 and a footrest 308. The seat box can also be suitably described as a seat deck, or seat base, or seat platform.

Each of prior art arm rest frames 306 includes a number of components, including outside arm rail 310, inside arm rail 312, and a plurality of arm fillers 314 connecting outside arm rail and inside arm rail. Arm rest frame 306 can further include cardboard or fiberboard for providing further shape or support to arm. As depicted, each of arm rest frames can includes about 19 parts or more, not including fasteners. Typically, a multitude of fasteners, such as staples, and wood glue are utilized for assembling the arm rest frames.

Prior art back rest 304 can include a number of components, including a top back rail 318, a bottom back rail or wing mount 320, one or more wings 322, one or more back posts 324, one or more back post stiffeners 326, a back brace 328, a breast rail 330, and webbing 332. As depicted, back rest includes about 15 parts. A multitude of fasteners, such as staples are utilized for assembling the back rest. The components described above are typically wood or wood products and need to be precisely cut to size.

Frame 300 can then be covered with fabric, leather, synthetic fabric, faux leather, microfiber, or other upholstery or covering materials. Such padding and covering materials are not depicted in FIGS. 1 and 2. The many wood components need to be precisely shaped by sawing or milling and are typically connected with fasteners, such as staples, and sometimes with adhesives.

A feature and advantage of embodiments is that the wood frame components of the arm rest forms and back rest forms may be swapped out with the blow molded arm rest form and blow molded back rest form without redesign of the other componentry of the recliner frame. A further feature and advantage of embodiments is that the upholstery coverings of the blow molded arm rest forms and blow molded back rest, as well as the upholstery covering of the seat deck may be installed on the respective components before frame components are assembled.

In embodiments, frame 84 depicted in FIGS. 2, 4, 8-12 may have approximately 8 principal components. In embodiments the frame can have up to and over 10 less parts, 20 less parts, or even greater than prior art wood recliner frame 300, depicted in FIG. 3. Also, not only is the number of components that need to be assembled is minimized, but the frame is simpler to assemble and the time for assembly is minimized, in part due to there being less secondary operations. In embodiments, the recliner frame 84 has 20 or less frame member components not counting fasteners. With respect to shipping, replacing the many wood components with the lighter weight blow molded components reduces freight costs, yet, frame 84 is robust, sturdy, and comfortable.

Arm rest forms can be formed in any of a number of desired furniture arm shapes including, by way of example, track, ruched, modern scroll, pad, track with nails, key, modern English, shelter, pleated, and saddle. Arm rest forms can include a top 218, a bottom 220, an outer lateral side 222, an inner lateral side 224, a front 226, and a back 228.

Figure 28:
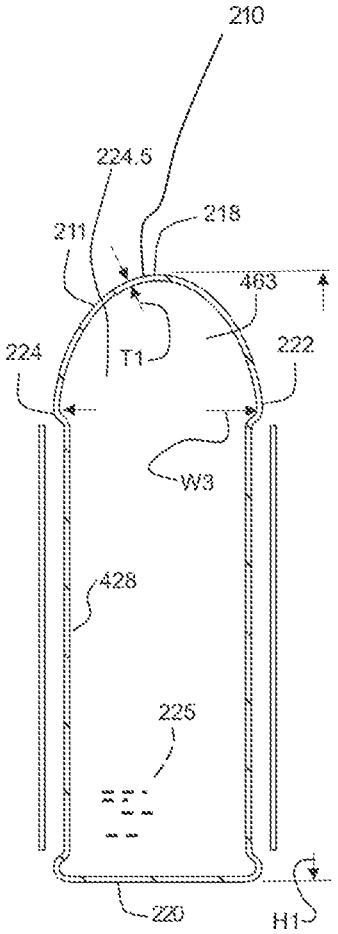
FIG. 28 is a cross sectional view of a blow molded arm rest form.
Figure 29:
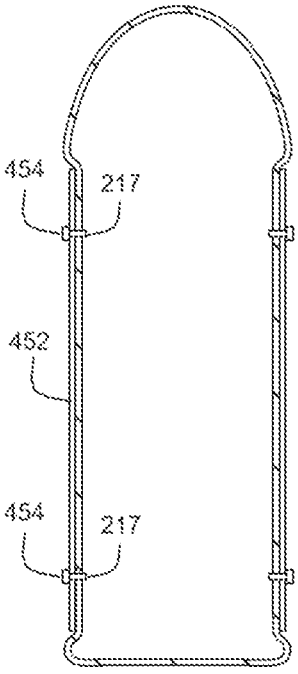
FIG. 29 is a cross sectional view of the blow molded arm rest form of FIG. 28 with reinforcing side panels attached thereto.
Figure 30:
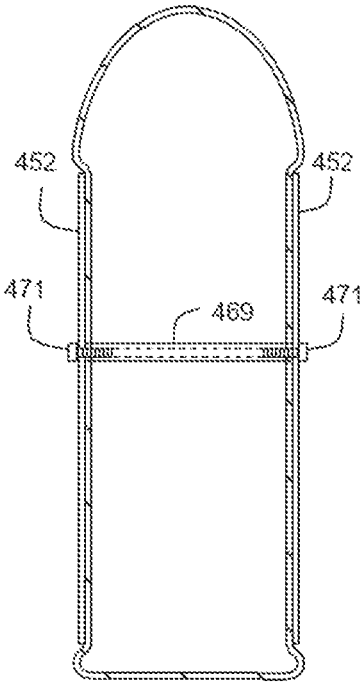
FIG. 30 is a cross sectional view of the blow molded arm rest form with a spacer in the interior of the arm rest form with the wall portion clamped between the spacer and the bolts.

In embodiments, as illustrated in the various figures, including FIGS. 28-30, arm rest forms 210, 402, 402.1 have a thin wall 211 that extends continuously about the top 218, bottom 220, two sides 222, 224, and the front and back of the form. The relatively thin wall compared to the height and volumetric size of the arm rest form allows resiliently deformability/deflectable upon impact, particularly for example if an individual unintentionally impacts the sofa with the arm rest form contained therein reducing the probability of an injury to such an individual. Referring specifically to FIG. 28, the average thickness T1 of the wall is in the range of from 0.04 to 0.25 inches. The height H1 of the hollow arm rest form may be, for example, in the range of 16 inches to 30 inches. Thus, in embodiments, the height of the arm rest form may be more than 60 times the average thickness arm rest form. In embodiments, the height of the arm rest form may be more than 100 times the average thickness arm rest form. In embodiments, the height of the arm rest form may be more than 200 times the average thickness arm rest form. In embodiments, the volume of the open interior 224.5 may be greater than 1 cubic foot. In embodiments, the volume of the open interior may be greater than 2 cubic feet. In embodiments, the volume of the open interior may be greater than 3 cubic feet. In embodiments, the maximum width W3 of the open interior is greater than 3.5 inches. In embodiments, the maximum width W3 of the open interior is greater than 4.5 inches. In embodiments, the maximum width W3 of the open interior is greater than 5.5 inches.

In embodiments, a ballast material 225 can be added to arm rest forms 210 to provide further stability and acoustical insulation to arms 210 and frame 84, generally. Such ballast material can include foam, such as a density foam, sand, cement, or other material. In embodiments, ballast can be added to arms 210 via a port or other opening in arm rest form (not depicted) that can include a cap or other closure structure that can be permanently or selectively closed.

Referring to FIGS. 8-12, recliner frames 400, 400.1 according to embodiments, may include four blow molded components (specifically, two arm rest forms 402, a back rest form 404, and a footrest or ottoman 406) is depicted. In the FIGS. 10-12 embodiment, footrest 406.1 may be a conventional wood panel. Frame 400 further includes a seat deck 407, reclining mechanism 408 for reclining function and a back rail 409. Seat deck 407 has a tubular steel frame 407.1 with connection flanges 407.5 for attaching to the blow molded arm forms 402, a plurality of seat springs 407.6, and a spring deck cover 407.7. A pair of forward holes 407.8 in the tubular steel frame 407.1 receive threaded fasteners that extend through interior wall of the arm rest form 402 at a forward seat deck mounting position 402.4 to attach to female threaded fasteners in or mounted to the arm rest form. Reclining mechanism 408 has a pair of connecting arms 408.4 to connect to the back rest, upwardly facing mounting flanges 408.1 for connection to the seat deck frame 407.1, forward facing mounting flanges 408.4 for connection to the foot rest form 406, and elongate rails 408.9 for engaging the floor such as through feet mounted thereon.

Back rest form 404 may be attached to recliner mechanism arms 408.4 via a coupler configured as a steel bracket 410, with a recess 411 such as depicted in FIGS. 14, 15, 17, and 18. Such brackets are known as kd clips.

Figure 26:
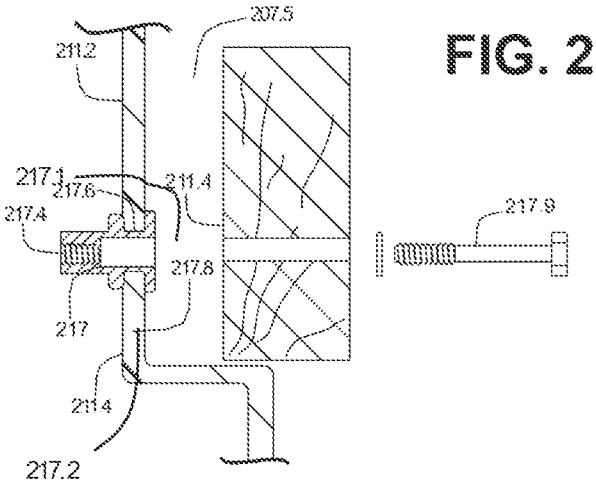
FIG. 26 is a cross sectional view of a rivet nut clamping onto a wall portion of a blow molded component as described herein.

Referring to FIGS. 28 to 30, blow molded arm rest forms 450 may be reinforced to provide enhanced weight carrying capacity or enhanced connectability to other componentry by utilizing plate 452 received in recesses 458 in sidewalls 462 of the arm rest form. As illustrated, the wall of the blow molded arm rest extends continuously around the top 218, two lateral sides 222, 224 walls, and bottom 220 without interruption closing the open interior 463 which defines a void volume. The reinforcing plates 452 may be secured with threaded fasteners 454 extending into the arm rest form wall 466, such as in a threaded insert 217 as illustrated in FIG. 26. Referring to FIG. 30, alternately, a spanning metal member, such as a piece of internally threaded tubing 469 that engages the plates and with screws 471 clamping the reinforcing plate to the ends of the tubing 469, thereby clamping against the interior and exterior surfaces of the polymer wall of the form. Such reinforcing plates can be used in association with the recliners disclosed herein, on the inside, outside or both sides of each blow molded arm rest form.

Figure 11:
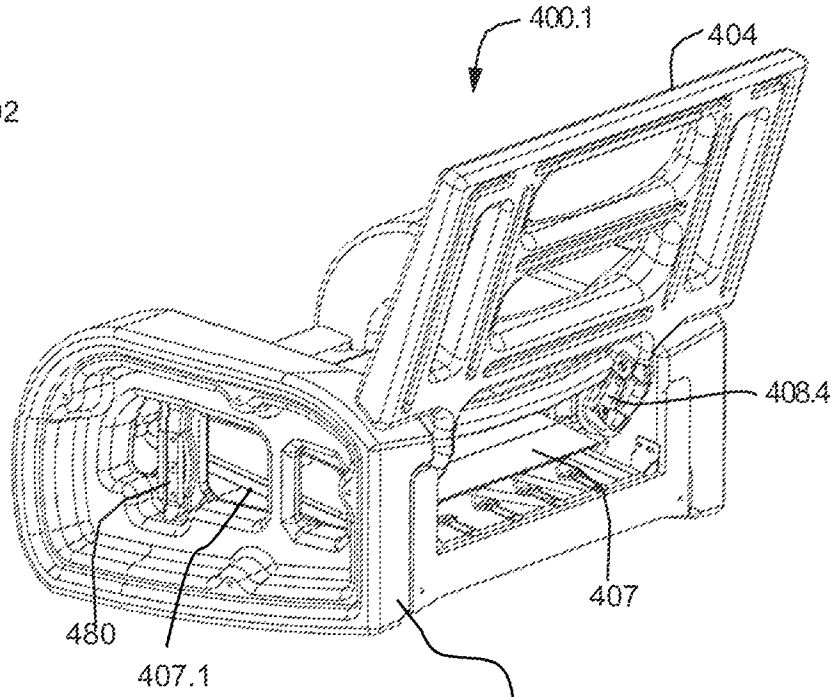
FIG. 11 is another perspective view of the recliner frame of FIG. 10 taken from the rear side corner.
Figure 10:
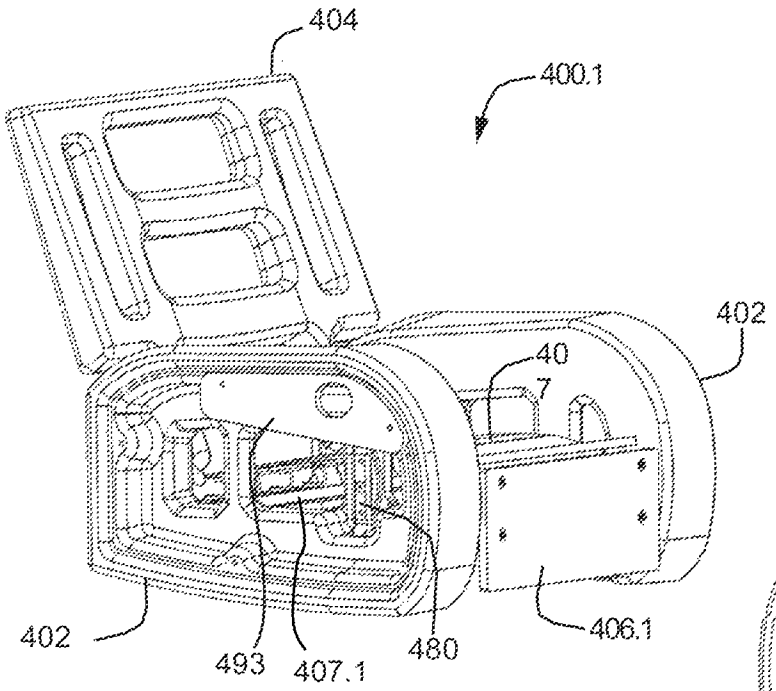
FIG. 10 is a front side perspective view of another recliner frame with alternate embodiments of arm rest forms and a back rest form.
Figure 12:
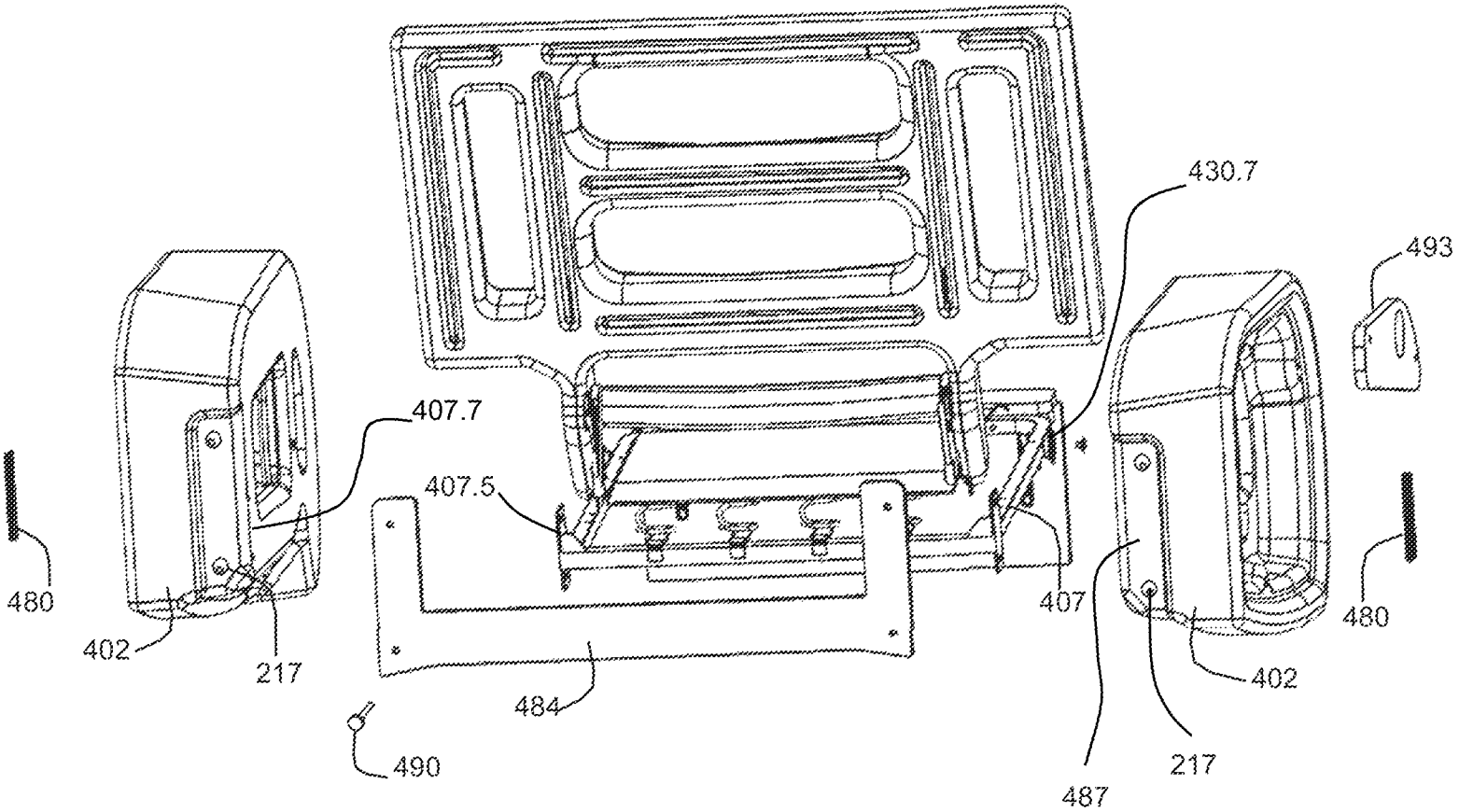
FIG. 12 is an exploded view of the recliner frame of FIGS. 10 and 11.
Figure 16A:
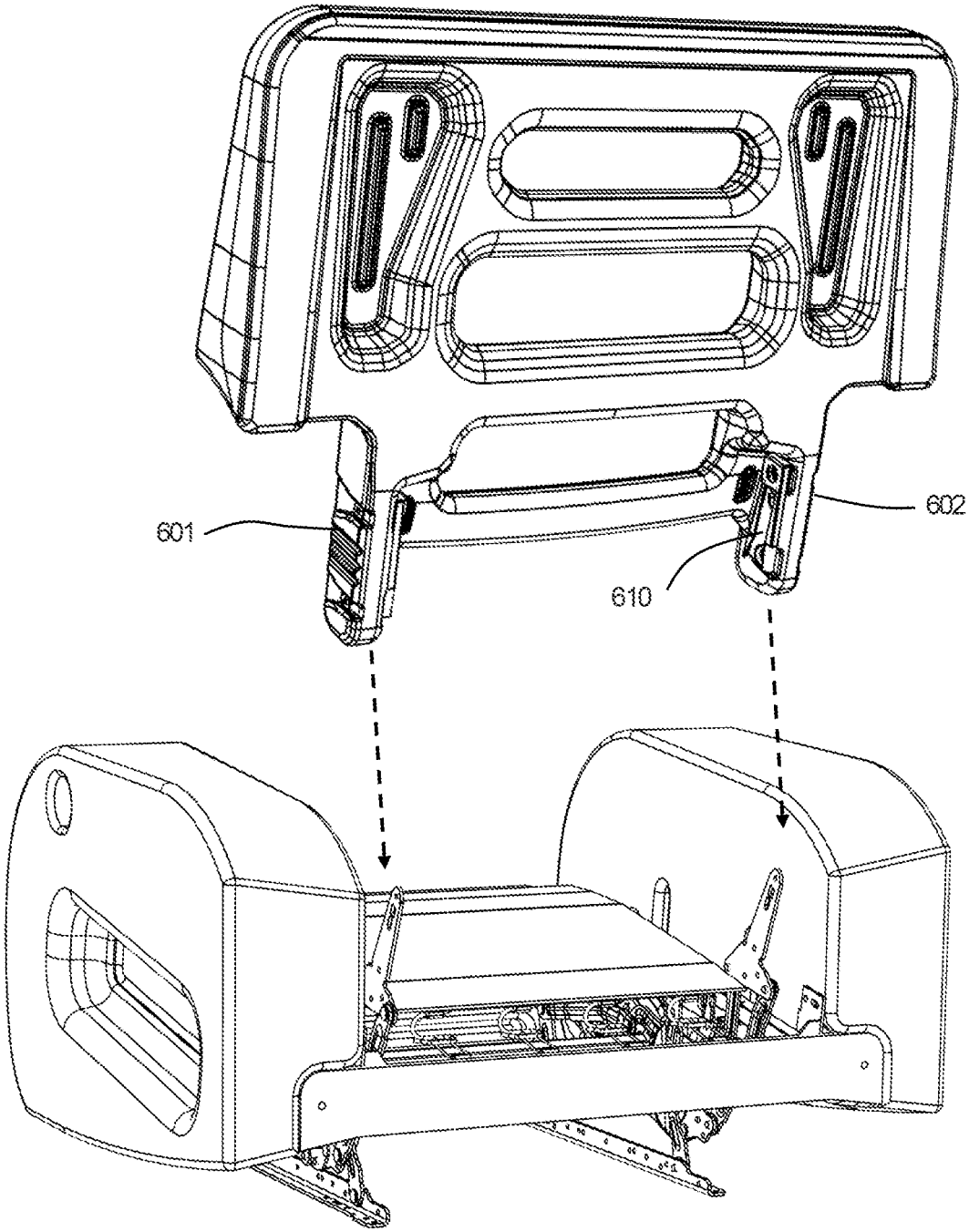
FIG. 16A is a rear perspective view of the unupholstered components of a recliner with a backrest having kd brackets for attachment to the cooperating brackets on a recliner mechanism in accord with embodiments.
Figure 16B:
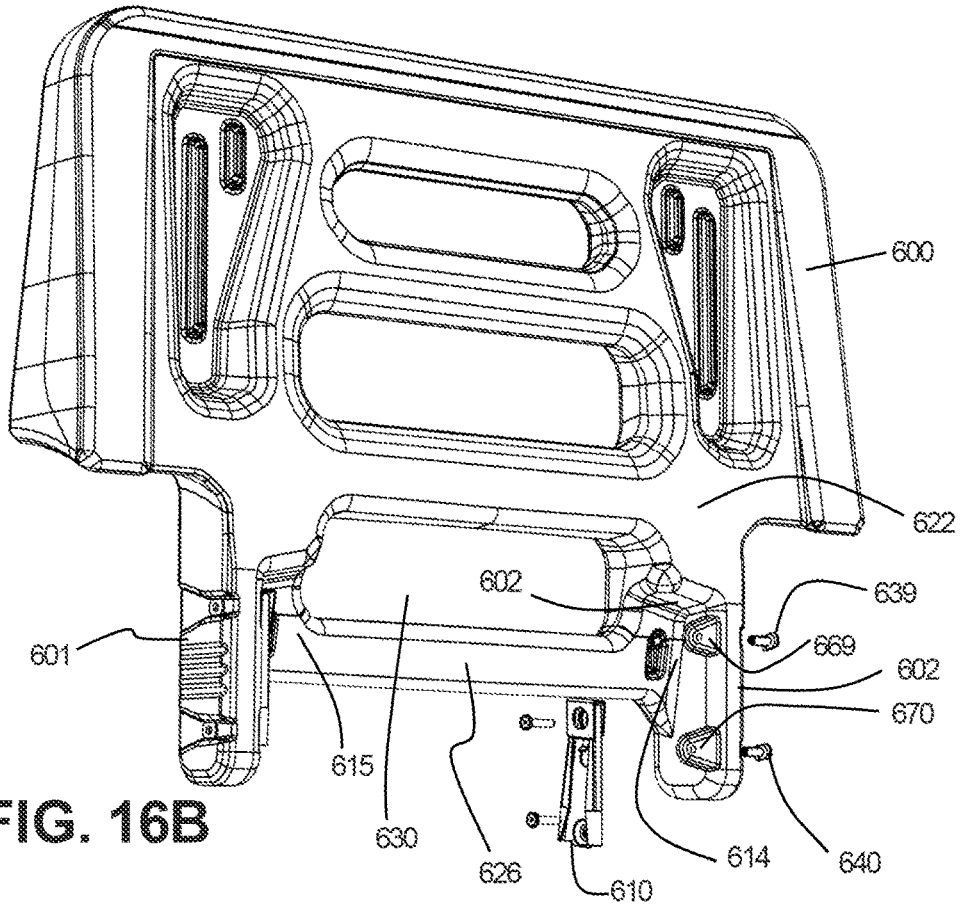
FIG. 16B is a rear perspective view of a molded backrest form with kd brackets attached according to embodiments.
Figure 16C:
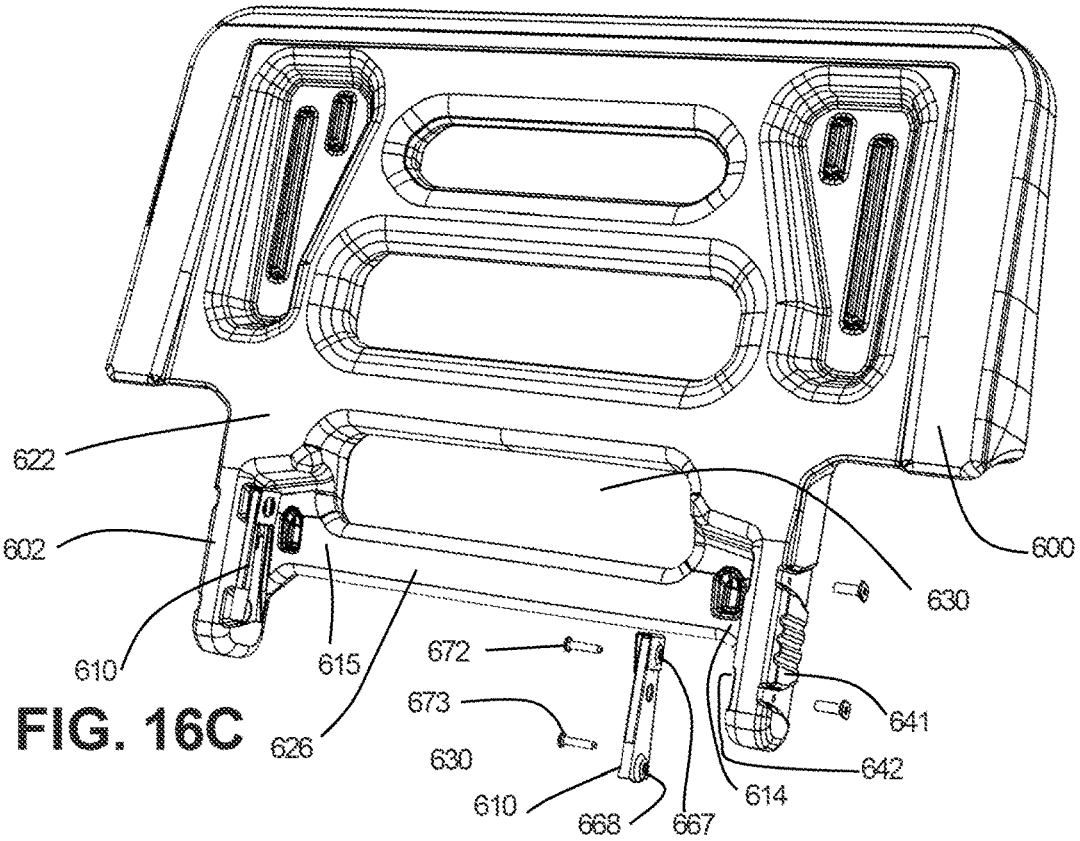
FIG. 16C is another rear perspective view of a molded backrest form with kd brackets attached according to embodiments.

The embodiment of FIGS. 10-12 has brackets or plates 480 that may be conformingly shaped attach to a column formed in the blow molded arm rest form on the outside wall surface and have a fastener extending through the arm rest form to connect to the seat deck 407 at frame aperture 407.3. See FIG. 16. A circular spacer 430.7 formed of polymer may be positioned between the seat deck frame and the exposed surface of the arm rest form. The two blow molded arm rest forms 402, 402.1 are connected on their back side 402.4 by a spanning lower rail configured as a U-shaped plate 484 that fits into recesses 487 defined by the wall of the arm rest form. Threaded connectors 217 are imbedded into the wall to receive threaded screws or bolts 490. The seat deck frame flanges 407.5 engage the arm rest form wall and are attached with bolts that engage with threaded fasteners in the wall of the arm rest form at attachment region 407.7. A wood plate 493 may be attached to provide support for an operator handle such as a handle to extend and retract the recliner.

Figure 13A:
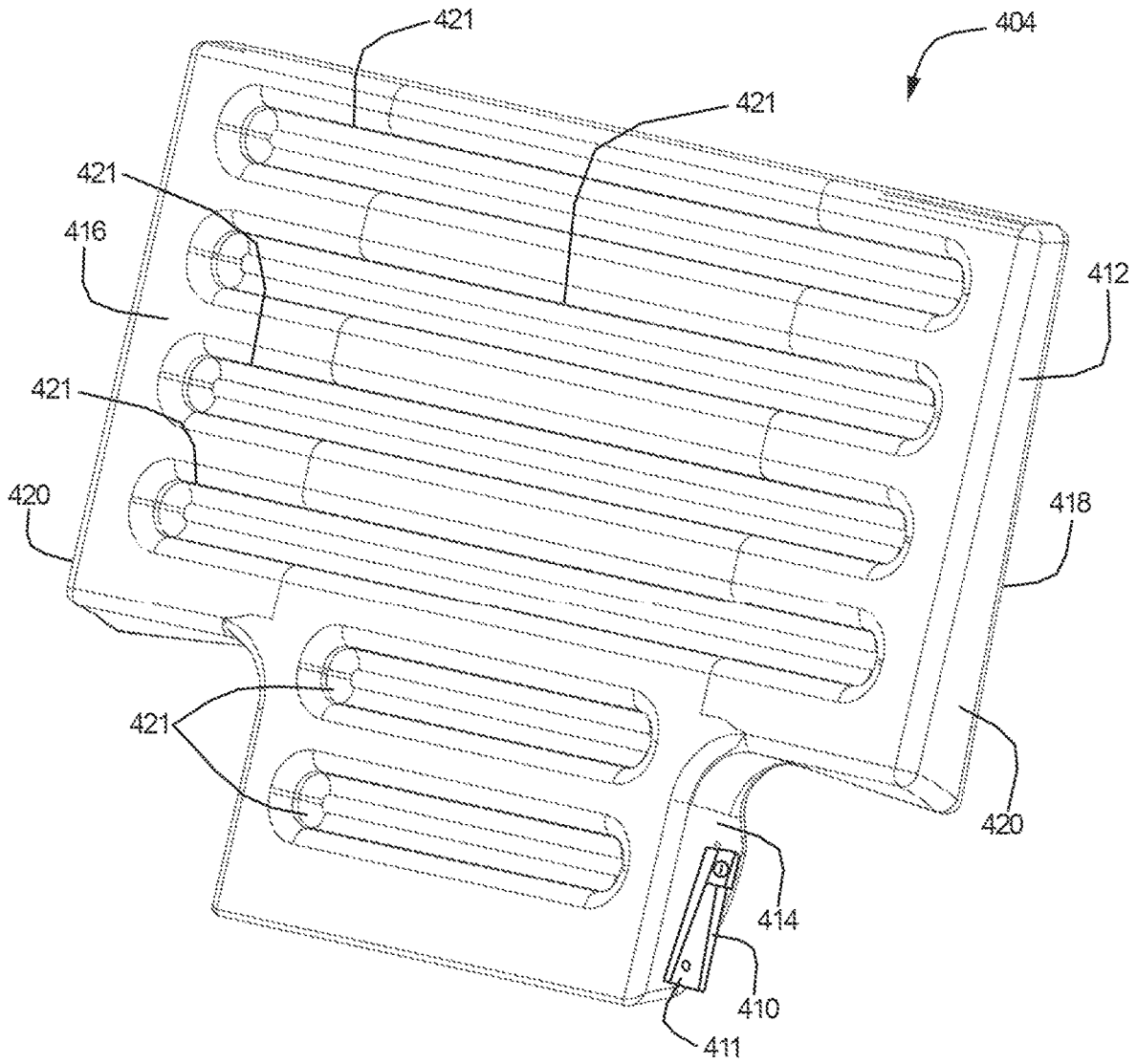
FIG. 13A is a perspective view of a blow molded back rest form with a bracket for attachment to a recliner mechanism.
Figure 13C:
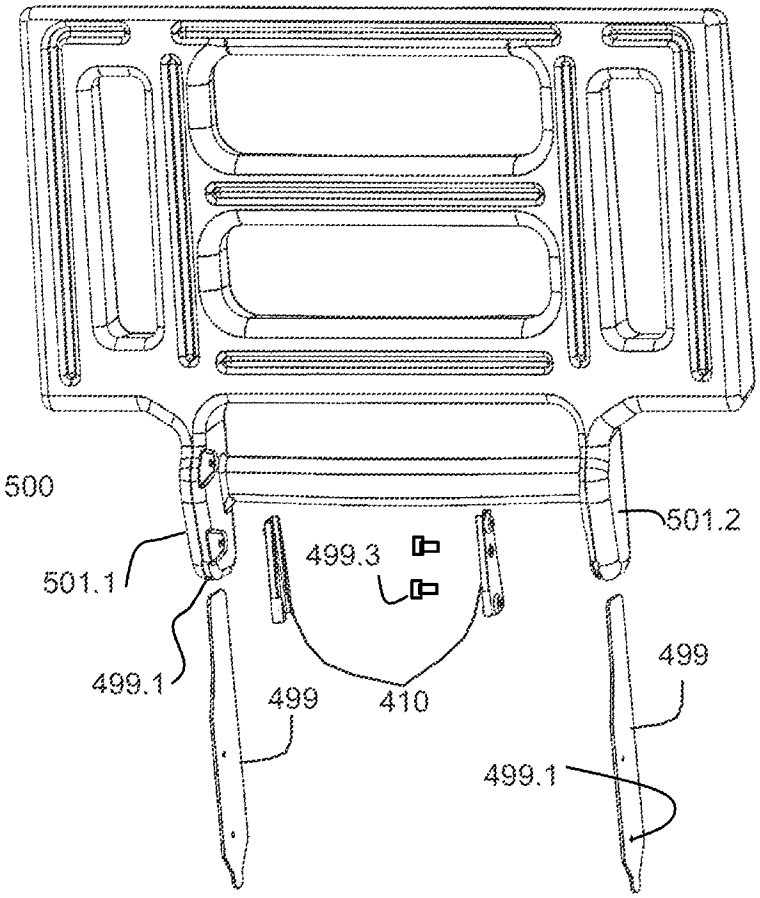
FIG. 13C is an exploded view of the back rest form of FIG. 14 with the reinforcing members and brackets separated from the form.
Figure 13B:
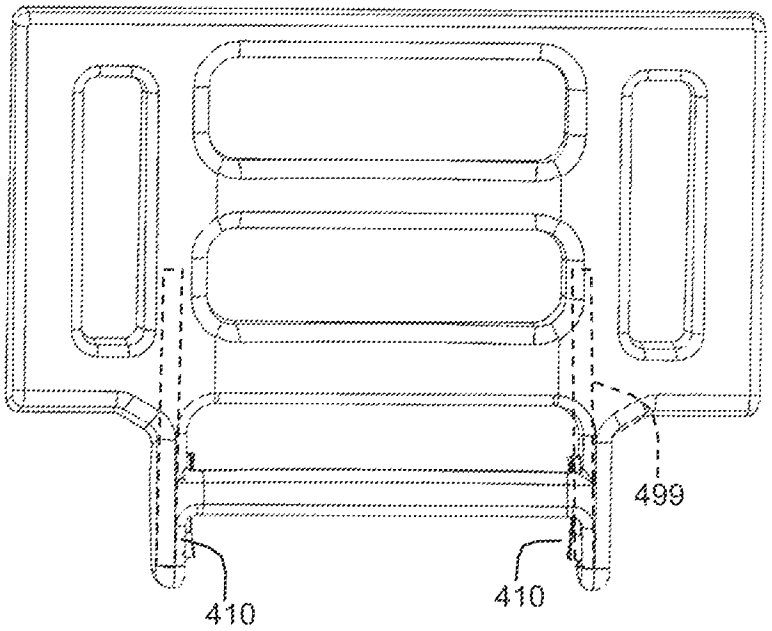
FIG. 13B is a perspective view of another embodiment of a blow molded back rest form with a bracket for attachment to a recliner mechanism.
Figure 15B:
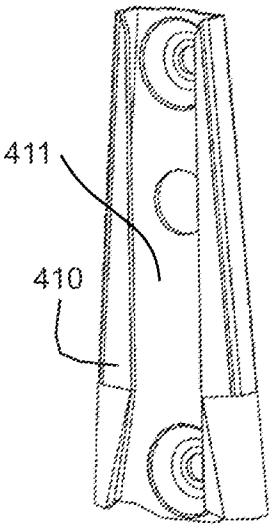
FIG. 15B is a perspective view of the bracket of FIG. 15A from the opposite side.
Figure 15A:
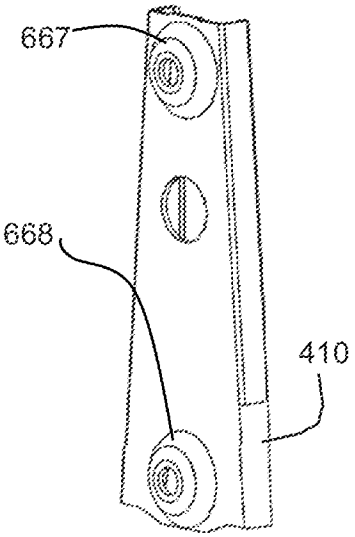
FIG. 15A is a front perspective view of the bracket on the back rest form for connecting to the prongs on the recliner mechanism.
Figure 14:
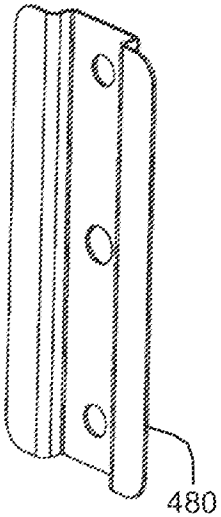
FIG. 14 is a perspective view of a reinforcing support bracket for the exterior side of the arm rest forms.

Referring to FIGS. 13A-13C, steel elongate interior reinforcing supports 499, configured as elongate arms, may be attached to the couplers 410 known as kd brackets. The elongate arms extend into the blow molded arm rest form 500 to provide resistance to bending. The reinforcing supports extend generally along the axis of the legs. Openings 499.1 may be made in the downward facing surfaces of the wall of the legs 501.1, 501.2 for insertion of the supports 499. The interior reinforcing supports may have threaded holes 499.1 to receive bolts 499.3 that clamp the polymer wall of the back rest form between the kd bracket 410 and the interior reinforcing support 499. In embodiments, the reinforcing supports may be formed of other materials such as wood, fiberglass, or other rigid polymers. Where the reinforcing supports 499 are formed of steel or other metals, self-tapping screws may be used, or threaded holes may be provided in the steel or other metal reinforcing supports. Where the supports are formed of wood, wood products, or polymers, metal female threaded inserts may be attached to the supports before insertion into the backrest form 404. Such interior reinforcing supports may also be used in the arm rest forms as well, particularly where the arm rest interior space is narrow.

Referring to FIGS. 16A-18D, another method of attaching kd brackets 610 to the arms 601, 602 of hollow back rest form 600 without utilization of the reinforcing supports of FIGS. 13B and 13C. The kd brackets 610 are nested into recesses 614, 615 defined by the legs 601, 602, a downwardly facing wall 620 of a main body portion 622 of the backrest form 600, and a cross member 626 unitary with the legs and the main body portion 622 of the arm. The cross member 626 and maid body portion define a window or opening 630 through the backrest form.

As illustrated in FIGS. 16B, 16C, 17A, 17B, 18A, 18B, and 18D, a pair of barrel nuts 639, 640 may extend into the legs where the opposing exterior walls 641, 642 of the legs extend into and through the interior 648 of the hollow legs defining tubular wall structures 650, 651 providing bores 653, 654 and tubular supports bridging between opposing walls 641, 642. Forming such structures are known to those skilled in the art of blowmolding and rotational molding. Such structures may be, for example, structures known as kiss-offs. An additional machining operation such as drilling a hole may be utilized to extend the opening through a kiss-off if it is not formed with a through hole during the molding process. The unitary tubular wall structures 650, 651 sized for receiving the barrel nuts 639, 640. The barrel nuts may extend from the outer side of the respective arms, through the arms. Flanges 658 of the barrel nuts engage the outer surface 660 of the outward wall 641. The kd bracket 610 may have a pair of dome shaped protrusions 667, 668 that are received in cooperating recesses 669, 670 on the inside wall 642 of the legs. A pair of screws 672, 673 extend through the kd bracket at the dome shaped protrusions and are threadingly engaged with the barrel nuts within the tubular wall structure. In embodiments the tubular wall structure may be axially compressed between the flanges 658 of the barrel nuts and the kd bracket dome shaped protrusions 667, 668. In embodiments the length of the barrel of the barrel nut may be sized to reduce the compression of the tubular wall structure. In embodiments, the barrel nut may extend from the inward wall of the respective leg and the screw from the outward wall of the respective leg.

Figure 17A:
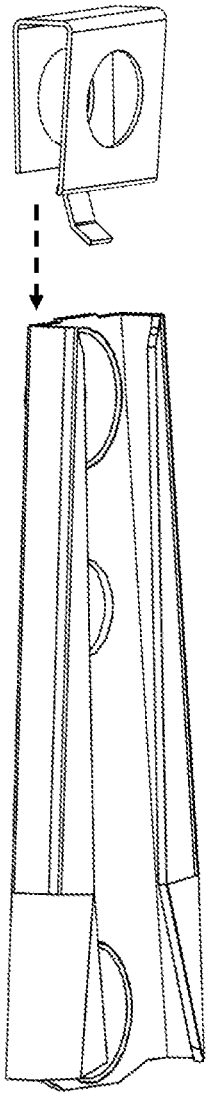
FIG. 17A Prior Art
FIG. 17A is exploded view of a prior art kd bracket.
Figure 17B:
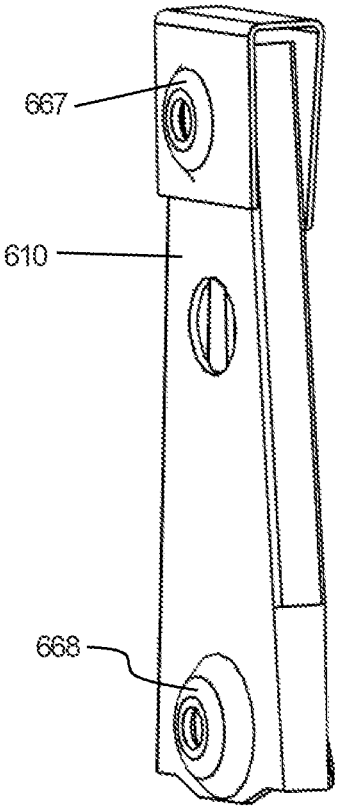
FIG. 17B Prior Art
FIG. 17B is a perspective view of a prior art kd bracket.
Figure 17C:
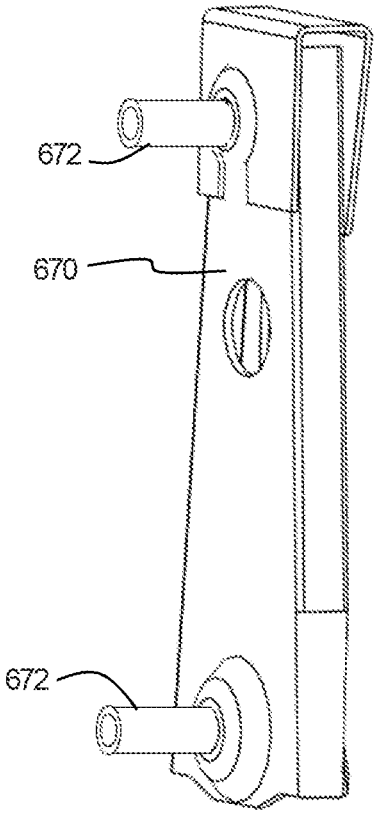
FIG. 17C is a kd bracket according to embodiments.
Figure 18A:
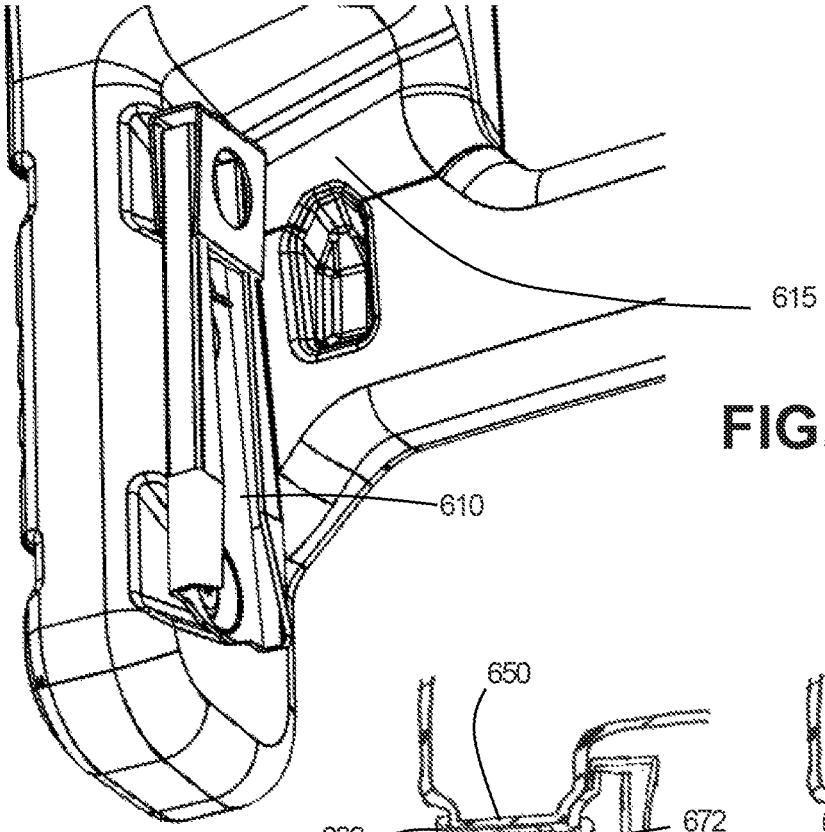
FIG. 18A is a perspective view of a kd bracket attached to a leg of a blow molded backrest form in accord with embodiments.
Figure 18B:
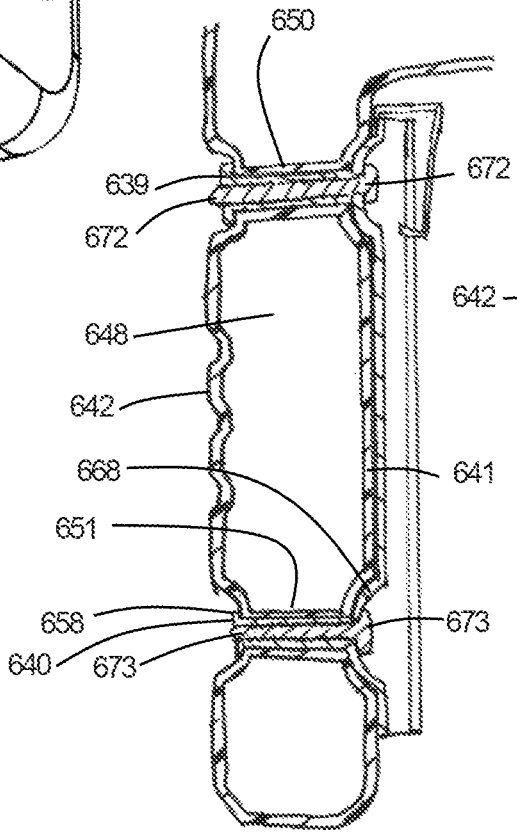
FIG. 18B is a cross-sectional view taken through the backrest form leg and kd bracket of FIG. 18A with the kd bracket of FIG. 17B.
Figure 18C:
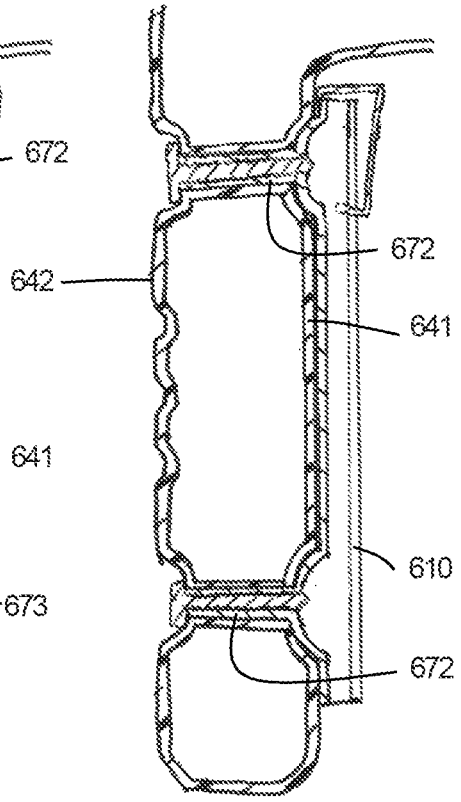
FIG. 18C is a cross sectional view taken through the backrest form leg and kd bracket of FIG. 18A with the kd bracket of FIG. 17C.
Figure 18D:
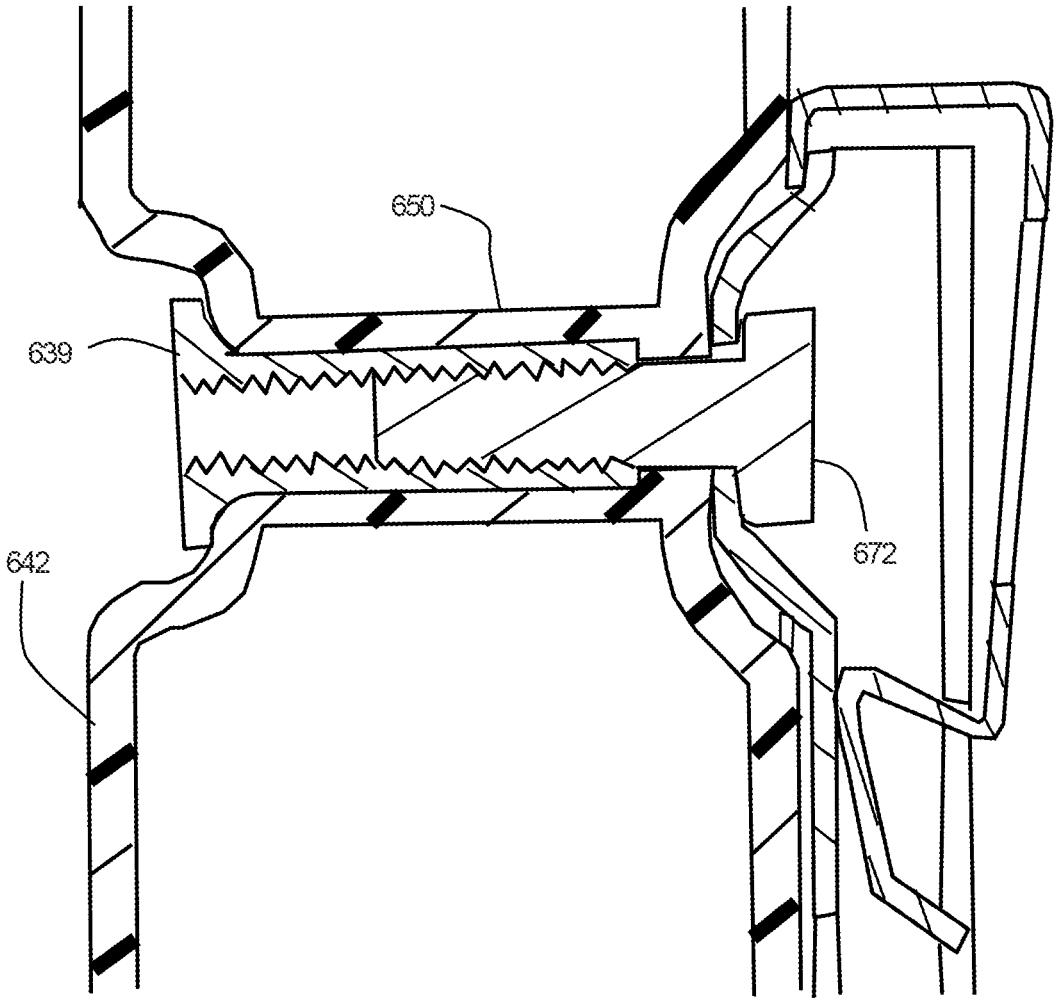
FIG. 18D is a detailed cross sectional view of an embodiment taken through the backrest form leg and kd bracket.

Referring to FIGS. 17C and 18C, in an embodiment, a kd bracket 670 may have a pair of interiorly threaded barrel nut portions 672 integrated with the kd bracket body 664 at the dome shaped protrusions. Assembly then comprises inserting the barrel nut portions of the kd brackets through the apertures from the inward walls of the legs and attaching the screws 670 from the outside walls into the barrel nuts clamping the kd bracket to the respective legs. The inventors have discovered that with this configuration, further internal reinforcing supports may be eliminated.

Figures 19, 20, 21, 22:
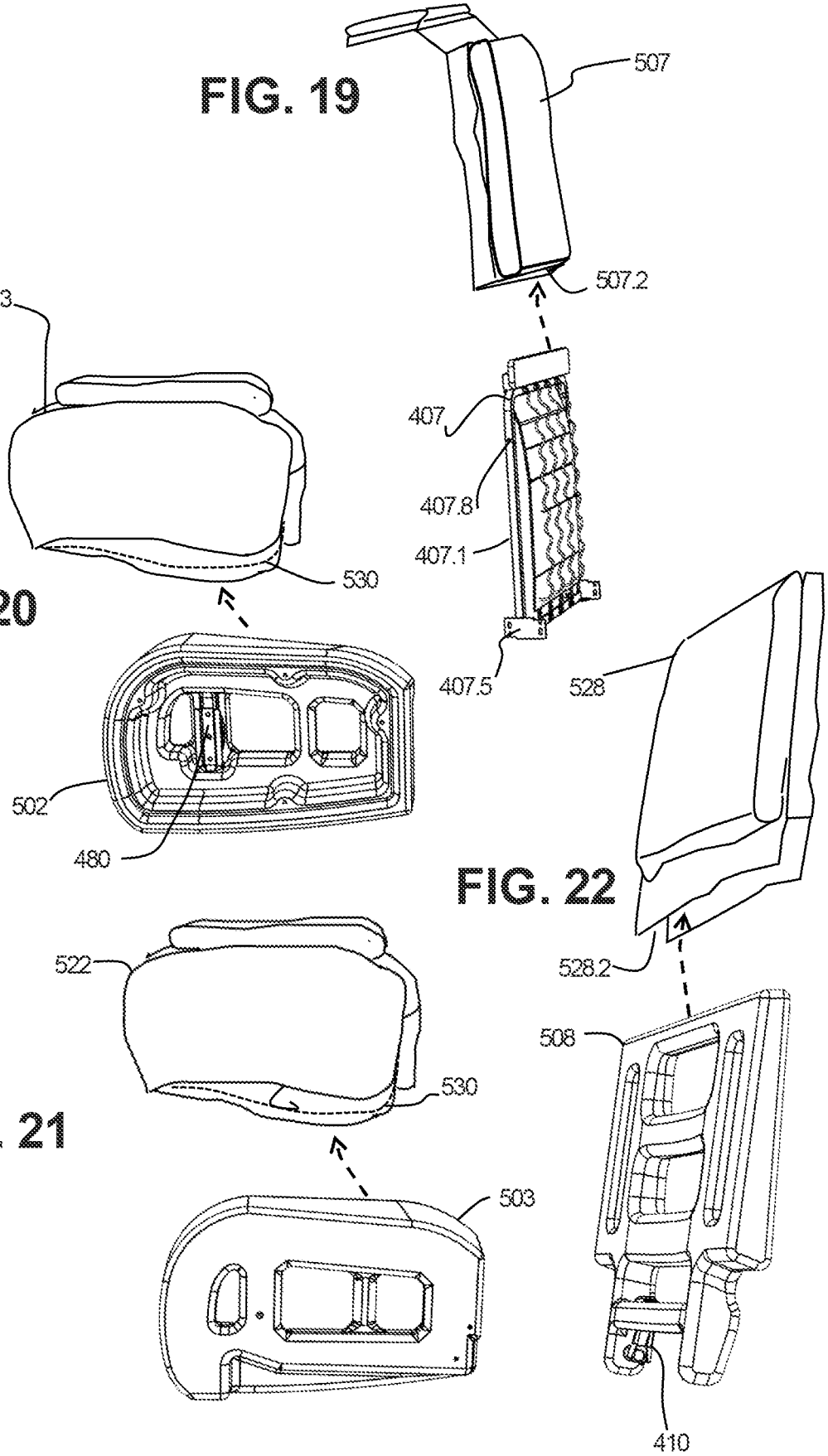
FIG. 19 is a perspective view of a recliner seat deck and an upholstery covering form fit for the seat base.
FIG. 20 is a left arm rest form and an upholstery covering form fit for the arm rest form.
FIG. 21 is a right arm rest form and the upholstery covering form fit for the arm rest form.
FIG. 22 is a back rest form with brackets and the upholstery covering form fit for the back rest form.

Referring to FIGS. 4, 8, 9, and 13A, in embodiments, back rest form 404 has a top portion 412 and a bottom portion 414 extending therefrom. Back rest form 404 further comprises a front wall portion 416, a back wall portion 418, and side wall portions 420. Front wall portion 416 and back wall portion 418 can include one or more structural recesses 421 to provide further structure, robustness, and sturdiness to sofa. Side wall portions 420 can include one or more apertures or openings 422 for use with connectors for connecting back rest form to other components of furniture structure. In embodiments, such as depicted in FIG. 19, back rest form includes bracket 410 for operably coupling backrest form 404 to another portion of frame 400, such as reclining mechanism 408 and/or arm rest forms 402. Bracket 410 can be connected to back rest form via apertures 422.

Continuing to refer to FIGS. 4, 8, 9, and 13A, an arm rest forms 402 can include a top 424, a bottom 426, an outside 428, an inside 430, a front 432, and a back 433. Inside 430 can further include one or more apertures or openings 436 for use with connectors for connecting arm rests 402 to other components of furniture structure and a projection 446 including an apertures or opening 436 for connecting arm rests 402 to other components of furniture structure, such as reclining mechanism 408 and/or the seat deck.

Arm rest forms may include one or more recesses or slots 438 configured for connection with back rail 409 and one or more apertures or openings 440 for use with connectors for connecting arm rests to other components of furniture structure. Referring to FIG. 24, outside wall portions 428 can include one or more structural recesses 442 to provide further structure, robustness, and sturdiness to chair frame 400 and an opening 444 for coupling a portion of reclining mechanism 408 thereto, by way of example, a handle or lever (not depicted) for operating reclining mechanism 408.

Continuing to refer to FIGS. 8-12, molded components, arm rest forms 402, back rest form 404, and footrest 406 can be connected to other components of frame 400 with various fasteners, such as brackets, screws, clips, and other fasteners.

Referring to FIG. 26, the wall 211.2 of the blow molded forms may be clamped within the threaded fastener known as a rivet nut 217. The rivet nut is positioned in an appropriately sized opening in the wall with the exterior flange portion on the exterior of the wall. The rivet is compressed against the wall thickness by pulling the threaded end 217.4 of the rivet toward the exterior flange 217.1 with a threaded tool (not shown) thereby forming an interior flange 217.2 that clamps and compresses the wall at the two wall surfaces between the exterior flange portion and the interior flange portion. The threaded tool is removed, and the threaded end is available to receive a threaded fastener 217 for securing a frame member or bracket or other component to the polymer form. Installation of the fastener clamps the fastener to the form wall. See U.S. Patent and Publication Nos. U.S. Pat. Nos. 9,309,914; 7,713,011; US2013/0316123; U.S. Pat. Nos. 9,651,080 and 9,028,185, each of which are incorporated by reference herein.

Figure 27:
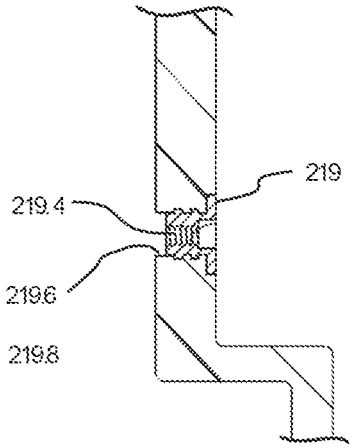
FIG. 27 is a cross sectional view of a winged connector with a screw attaching and clamping onto a wall portion of a blow molded component as described herein.

Referring to FIG. 27, another method of attachment of wood or steel frame members to the blow molded component illustrated with the insertion of a metal insert with external threads that grip and bind with the polymer wall. A threaded aperture in the metal insert receives a cooperating bolt or other male threaded member. Referring to FIG. 4B, a metal insert 219 having a threaded bore 219.4 may be driven into a hole 219.6 formed in the wall portion 219.8 of the blow molded arm rest form or other blow molded component. See U.S. Pat. Nos. 9,651,080 and 9,028,185, each of which are incorporated by reference herein. The metal threaded insert 219 may receive a bolt, to connect molded components to other components.

Referring to FIGS. 19 to 25B, a method of assembling a recliner 600 is illustrated. Blow molded arm rest forms 502, 503, a blow molded back rest form 508, a seat deck 407, a footrest form, and a recliner mechanism 408 are provided. Brackets, support arms, plates and threaded fasteners, are installed in the forms at locations as illustrated above, where the components are to be joined or are to be reinforced. Conforming upholstery socks are provided, a conforming left arm rest upholstery sock 522, a conforming right arm rest upholstery sock 523, a conforming seat deck upholstery sock 507 with an open rearward end 507.2, and a conforming back rest upholstery sock 528 with an open lower end 528.2. The conforming arm rest upholstery socks may have zippers 530 for securing the conforming sock on the respective arm rest forms. The form fitting upholstery socks are installed on the respective components. The conforming seat deck upholstery sock remains open at the rearward open end 507.2 end allowing access to flange plates 407.5 that attach to the inside surfaces of the arm rest forms, and has preformed apertures 507.8, show in FIG. 23, that allow access to the seat deck frame 407.1 for forward attachment to the arm rest forms and to the recliner mechanism with threaded fasteners, such as bolts, during assembly with the upholstery covering preinstalled on the seat deck 407. Such preformed apertures are made during the sewing stage of the conforming upholstery coverings. The form fitting upholstery coverings of the back rest form and seat deck form may have hook and loop material to close the respective open ends of the upholstery socks. Such closure may be after the final connection and assembly of the components.

Referring to FIG. 23, the left arm rest 532, the right arm rest 533 are connected to the covered seat deck 532 at the steel frame members forwardly and rearwardly, at the rearward flanges 407.5 with bolts extending into threaded fasteners in the arm rest forms, and through the frame 407.1 at holes 407.8, through the arm rest form and through or threaded into the bracket 480 on the exterior side surface of the respective arm rest forms. The arm rests 532, 533 are further connected by attachment of the spanning frame member 484, again with bolts extending through the spanning frame member into threaded fasteners secured in and to the arm rest forms. The assembly is positioned upside down on a jig 539. The recliner mechanism 408 is attached to seat deck arm rest assembly 547, specifically by bolting it to the seat deck, with the recliner mechanism back rest arms 543 pointing downwardly. See FIGS. 8 and 9 above for attachment locations defined by the upwardly facing flanges 408.1. The footrest form 406 is inserted in the seat deck upholstery 507 covering, if not already installed, and the footrest form is secured to the recliner mechanism with threaded fasteners at the forward facing flanges 408.4. The back rest 538, including the back rest form 508 and upholstery covering 528, is installed onto the recliner back rest arms 543, 544, utilizing the kd clips as described above. The arms snap and lock into the respective kd clips. The recliner is then substantially assembled on the jig 539 where it may be then flipped to the right side up as shown in FIG. 25B.

In embodiments, minor additional assembly steps may be needed for connecting cables for the recliner, attaching feet, or the like.

Various direction-indicating terms are used herein as a convenient way to discuss the objects shown in the figures. It will be appreciated that many direction indicating terms are related to the instant orientation of the object being described. It will also be appreciated that the objects described herein may assume various orientations without deviating from the spirit and scope of this detailed description. Accordingly, direction-indicating terms such as "upwardly," "downwardly," "forwardly," "backwardly," should not be interpreted to limit the scope of the invention recited in the attached claims.

The following United States patents and patent applications/publications are hereby incorporated by reference herein: U.S. Pat. And Pub. Nos. US 2022/0071398, US 2020/0029699, U.S. Pat. Nos. 7,070,243, 6,854,806, 6,702,391, 6,679,558, 5,582,460, 5,755,489, 5,575,533, 4,775,187, 3,877,087, 3,669,495, 3,658,382, 10,299,606, 10,117,521, 10,034,554, 9,839,295, 9,474,381, 8,777,319, 8,448,314, 8,438,716, 7,988,236, 7,806,482, 9,309,914, 7,713,011, US2013/0316123, U.S. Pat. Nos. 8,764,115, 9,651,080, 9,028,185, 9,526,342, 7,438,362, and WO2018/081471. The above references and all U.S. patents and publications in all sections of this application are herein incorporated by references in their entirety for all purposes. Components illustrated in such patents may be utilized with embodiments herein. Incorporation by reference is discussed, for example, in MPEP section 2163.07(B).

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed. The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. An upholstered recliner having two blow molded arm rest forms, a pair of upholstery socks conformingly sized and positioned on respective ones of the two blow molded arm rest forms, a blow molded backrest form, and a seat deck, each of the blow molded arm rest forms being hollow and having a continuous polymeric wall extending around a top, two lateral sides, a forward side, a rearward side, and a bottom side, each arm rest form attached to the seat deck, a recliner mechanism positioned under and attached to the seat deck, wherein the backrest form has a pair of downwardly extending legs, each leg having a coupling bracket on an inward wall of each leg, each coupling bracket attached at a tubular wall structure extending from the inward wall to an outward wall, with a barrel nut extending from one of the inward wall and outward wall and a screw cooperating with the barrel nut and extending from the other of the inward wall and outward wall, wherein the tubular wall structure is compressed with the engagement of the barrel nut and screw.

2. The upholstered recliner of claim 1, wherein the barrel nut is integrated with each coupling bracket.

3. The upholstered recliner of claim 1, wherein each coupling bracket has a pair of dome shaped protrusions positioned in cooperating recesses on the inward wall of the respective legs of the backrest form.

4. The upholstered recliner of claim 1, wherein each of the legs of the backrest form are formed without internal reinforcing support.

5. The upholstered recliner of claim 1, wherein the blow molded arm rest forms have a reinforcing plate on an exterior lateral side of each of the blow molded arm rest forms.

6. The upholstered recliner of claim 5, wherein each of the reinforcing plates is positioned on and attached to a vertical column defined by a pair of windows extending through each of the arm rest forms.

7. An upholstered recliner comprising:

a pair of blow molded polymer arm rest forms, each of the arm rest forms being hollow and having a continuous wall extending around a top, two lateral sides, a forward side, a rearward side, and a bottom side;

a seat deck bolted inbetween the pair of molded polymer arm rest forms, each of the molded arm rest forms having threaded fasteners clamped to respective wall portions of each one of the pair of molded polymer arm rest forms.

8. The upholstered recliner of claim 7, wherein each of the pair of blow molded arm rest forms each has a respective form fitting upholstery sock thereon.

9. The upholstered recliner of claim 7, further comprising a blow molded backrest form covered by a form fitting upholstery sock.

10. The upholstered recliner of claim 9, wherein the seat deck has a form fitting upholstery sock thereon.

11. The upholstered recliner of claim 10, wherein each of the form fitting upholstery socks are openable and closeable by a zipper or hook and loop material.

12. The upholstered recliner of claim 7, wherein each of the threaded fasteners is a rivet nut.

13. The upholstered recliner of claim 7, wherein each of the polymer arm rest forms having a recess for a lower rearward spanning wood rail and each of the recesses having a plurality of threaded inserts therein and the lower rearward rail is attached to each of the polymer arm rest forms with a threaded screw extending through the lower rearward rail into the threaded inserts.

14. The upholstered recliner of claim 7, wherein each of the polymer arm rest forms having a vertical column defined by a pair of windows therein.

15. The upholstered recliner of claim 7, further comprising a molded back rest that is secured to a recliner mechanism positioned below the seat deck.

16. The upholstered recliner of claim 15, wherein the molded back rest and each of the polymer arm rest forms are blow molded with a wall defining an interior.

17. The upholstered recliner of claim 16, wherein each arm rest form has an internal volume of at least 1 cubic foot.

18. The upholstered recliner of claim 1, wherein the back rest form has a form fitting upholstery sock thereon.

19. The upholstered recliner of claim 18, wherein the seat deck has a form fitting upholstery sock thereon.

20. The upholstered recliner of claim 19, wherein each of the form fitting upholstery socks are openable and closeable by a zipper or hook and loop material.

* * * * *